US012745865B2

(12) United States Patent
Whitehead et al.

(10) Patent No.: US 12,745,865 B2
(45) **Date of Patent: *Sep. 29, 2026**

(54) BEVERAGE SERVICE STATION AND BAR

(71) Applicant: Suncast Technologies, LLC, Palm Beach Gardens, FL (US)

(72) Inventors: Stephen Whitehead, Elgin, IL (US); Robert Kopp, Elburn, IL (US); Torrence Anderson, Overland Park, KS (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 132 days.

This patent is subject to a terminal disclaimer.

(21) Appl. No.: 18/438,365

(22) Filed: Feb. 9, 2024

(65) Prior Publication Data

US 2024/0245235 A1 Jul. 25, 2024

Related U.S. Application Data

(63) Continuation-in-part of application No. 18/342,847, filed on Jun. 28, 2023, which is a continuation-in-part of application No. 29/838,190, filed on May 11, 2022, now Pat. No. Des. 1,033,102.

(51) Int. Cl.
*A47F 9/00* (2006.01)

(52) U.S. Cl.
CPC ..... *A47F 9/00* (2013.01)

(58) Field of Classification Search
CPC . A47F 9/00; A47B 37/04; A47B 69/00; E04B 1/19; E04B 17/18
USPC ..... 312/140.1, 140.2, 257.1, 263–265, 312/265.1–265.6, 351.1, 351.3; 108/92, 108/901; 52/653.1
See application file for complete search history.

(56) References Cited

U.S. PATENT DOCUMENTS 1,002,950 A * 9/1911 Wise ..... C10M 173/00 62/337
2,287,657 A * 6/1942 Wisckol ..... D06F 1/00 68/3 R
3,588,209 A * 6/1971 Nathan ..... A47B 43/00 312/258
3,805,321 A * 4/1974 Hodge ..... B60B 33/0002 248/188
4,042,660 A 8/1977 Bishop
4,687,262 A * 8/1987 St. Louis ..... A47L 15/427 312/319.1

(Continued)

FOREIGN PATENT DOCUMENTS

DE 1933570 1/1971
DE 202008014683 U1 * 9/2009 ..... A47F 9/00

(Continued)

*Primary Examiner* — Janet M Wilkens
(74) *Attorney, Agent, or Firm* — McHale & Slavin, P.A.

(57) ABSTRACT

The device involves a beverage station and bar. The beverage station and bar is constructed from lightweight blow molded panels secured to a metal frame. This construction provides a structure that can be shipped to homes and assembled on site.

Ballast containers that utilize locally sourced ballast material are securable within the base of the beverage station and bar to provide stability and reduce the tendency of the beverage station and bar to tip from users leaning against the structure during use.

11 Claims, 46 Drawing Sheets

(56) References Cited

U.S. PATENT DOCUMENTS

| | | | | |
|---|---|---|---|---|
| 5,220,765 | A * | 6/1993 | Kubik | E04B 1/19 52/650.1 |
| 5,785,293 | A * | 7/1998 | Ford | F16M 3/00 248/676 |
| 7,076,922 | B1 * | 7/2006 | Parres | E04B 1/8218 52/79.5 |
| 7,427,642 | B2 | 9/2008 | Kwon | |
| 8,709,322 | B2 | 4/2014 | Boor | |
| 9,527,341 | B2 | 12/2016 | Rassi et al. | |
| 9,839,294 | B2 * | 12/2017 | Thuma | B29C 49/0031 |
| 11,383,419 | B2 | 7/2022 | Anderson et al. | |
| 2007/0186341 | A1 * | 8/2007 | Uffner | A47K 1/02 4/619 |
| 2007/0257585 | A1 * | 11/2007 | Kenny | A47B 77/00 312/265.4 |
| 2014/0306584 | A1 * | 10/2014 | DeMars | A47F 10/06 312/140.2 |
| 2015/0376917 | A1 * | 12/2015 | Brunner | B25H 3/028 312/257.1 |
| 2020/0047389 | A1 | 2/2020 | Rassi et al. | |

FOREIGN PATENT DOCUMENTS

| | | | | |
|---|---|---|---|---|
| DE | 202013009007 | U1 * | 1/2014 | A47B 45/00 |
| EP | 0059408 | | 9/1982 | |
| EP | 1992258 | A1 * | 11/2008 | A47F 9/00 |
| EP | 3292799 | A1 * | 3/2018 | A47F 5/10 |
| GB | 2255525 | | 11/1992 | |
| JP | 2002104857 | | 4/2002 | |
| JP | 2007530411 | | 11/2007 | |
| KR | 100796437 | | 1/2007 | |
| KR | 20090085819 | | 8/2009 | |
| KR | 2010020779 | | 2/2010 | |
| WO | WO2010101372 | | 9/2010 | |
| WO | WO2011078476 | | 6/2011 | |
| WO | WO2021074150 | | 4/2021 | |

* cited by examiner

BEVERAGE SERVICE STATION AND BAR

RELATED APPLICATIONS

In accordance with 37 C.F.R 1.76, a claim of priority is included in an Application Data Sheet filed concurrently herewith. Accordingly, this application is a continuation in part of U.S. patent application Ser. No. 18/342,847, entitled BEVERAGE SERVICE STATION AND BAR, filed Jun. 28, 2023, which is a continuation in part of U.S. patent application Ser. No. 29/838,190, entitled PATIO BAR, filed May 11, 2022, the contents of which are incorporated herein.

FIELD OF INVENTION

The present invention generally relates to mobile beverage stations and, more particularly, to a lightweight polymeric beverage station and bar that can be shipped in a disassembled condition and assembled at a remote location with the user adding locally available weight material to create a stabilized structure which can be maneuvered on cantilevered casters which broaden the base of the beverage station and allow it to be rolled to a desired position.

BACKGROUND INFORMATION

Beverage stations, and particularly those that can be used as a stand-up bar, are known in the art. The known beverage stations are generally heavy permanent structures made from metal, wood and steel. The location of the liquids, which is generally at the top surface of the beverage station, makes the structures definitively top heavy. Thus, the structures are generally very heavy to both support the heavy liquids stored in and on the bar, and to prevent tipping when patrons lean against the bar. In order to facilitate movement of the heavy structures, many are provided with wheels. However, the wheels exacerbate the tipping problem and add an additional problem of preventing the structure from inadvertently moving when used.

An additional drawback to the known structures relates to the cost associated with shipping and moving the beverage stations to their desired location. The weight of the structures requires loading docks, forklifts, and multiple personnel to move and set up the beverage stations.

Therefore, what is needed in the art is a beverage station and bar that is lightweight and easily shipped for delivery at a home address. The beverage station and bar should be easily and quickly assembled using minimal hardware and requiring a minimal number of tools. Further, the system should not require excessive strength to assemble or include heavy component parts. Moreover, the system must assemble together in such a way so as not to detract from the aesthetic appearance of the assembled beverage station and bar. Still, the system should include wheels arranged outside of the footprint of the base of the beverage station to provide for easy movement of the beverage station without compromising stability.

Thus, the present invention provides a beverage station and bar which overcomes the disadvantages of prior art.

The beverage station and bar structure of the present invention not only provides for relative ease in the assembly, but the structure also permits a lightweight overall structure that can withstand large loads and resists tipping.

SUMMARY OF THE INVENTION

Briefly, the invention involves a beverage station and bar. The beverage station and bar is constructed from lightweight blow molded panels secured to a metal frame. This construction provides a structure that can be shipped to homes and assembled on site. Ballast tanks that utilize locally sourced ballast material are securable within the base of the beverage station and bar to provide stability and reduce the tendency of the beverage station and bar to tip from users leaning against the structure during use.

Accordingly, it is an objective of the present invention to provide a beverage station and bar.

It is a further objective of the present invention to provide a beverage station and bar that can be shipped in a disassembled condition and shipped to a home.

It is yet a further objective of the present invention to provide a beverage station and bar that is constructed from hollow blow molded polymeric panels including a metal structure.

It is another objective of the instant invention to provide a beverage station and bar that includes ballast tanks securable within the base of the beverage station and bar to provide stability to the structure.

It is still another objective of the present invention to provide a beverage station that includes wheels to provide portability.

It is still another objective of the present invention to provide a beverage station that includes wheels secured on outriggers to provide a base larger than the beverage station footprint for stability and portability.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
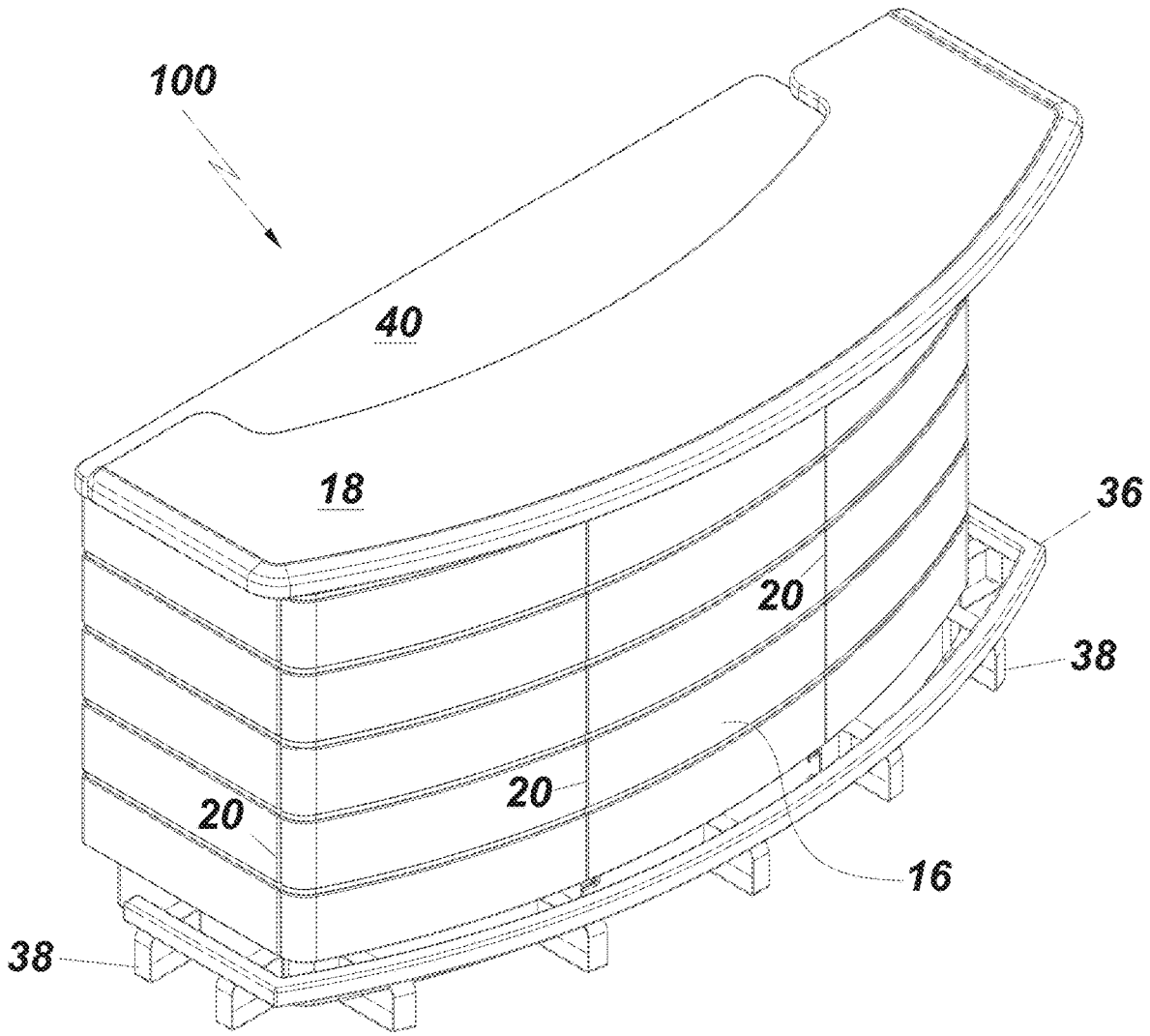
FIG. 1 is a top front left perspective view of one embodiment of the beverage station and bar.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
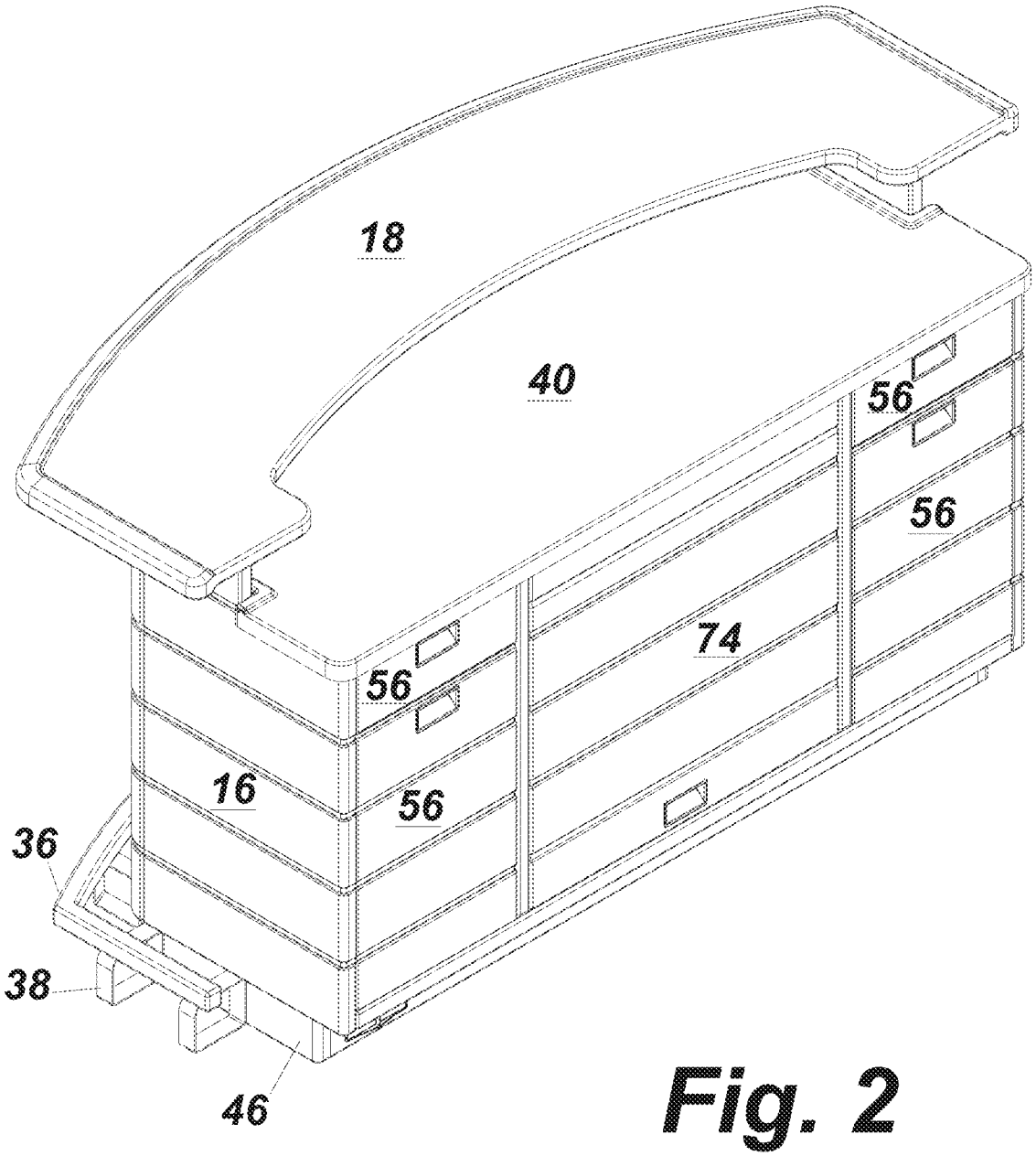
FIG. 2 is a top rear right perspective view thereof.
Figure 3:
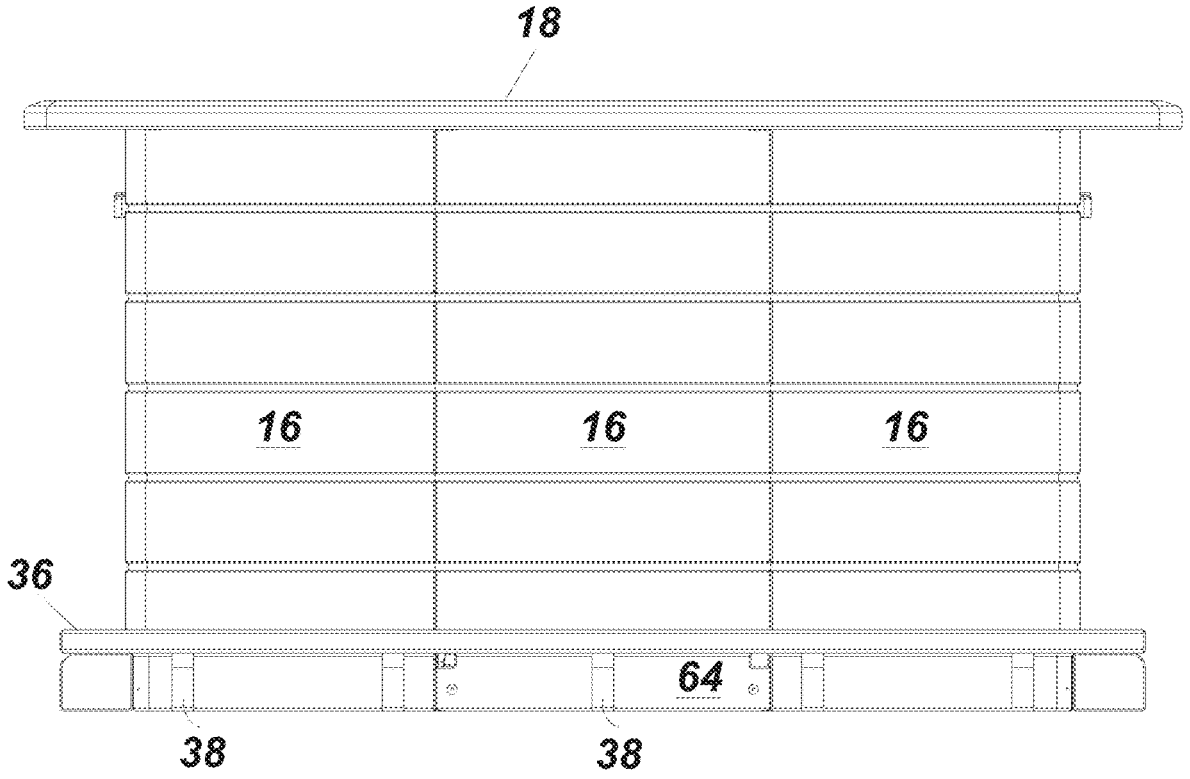
FIG. 3 is a front view of the embodiment shown in FIG. 1.
Figure 4:
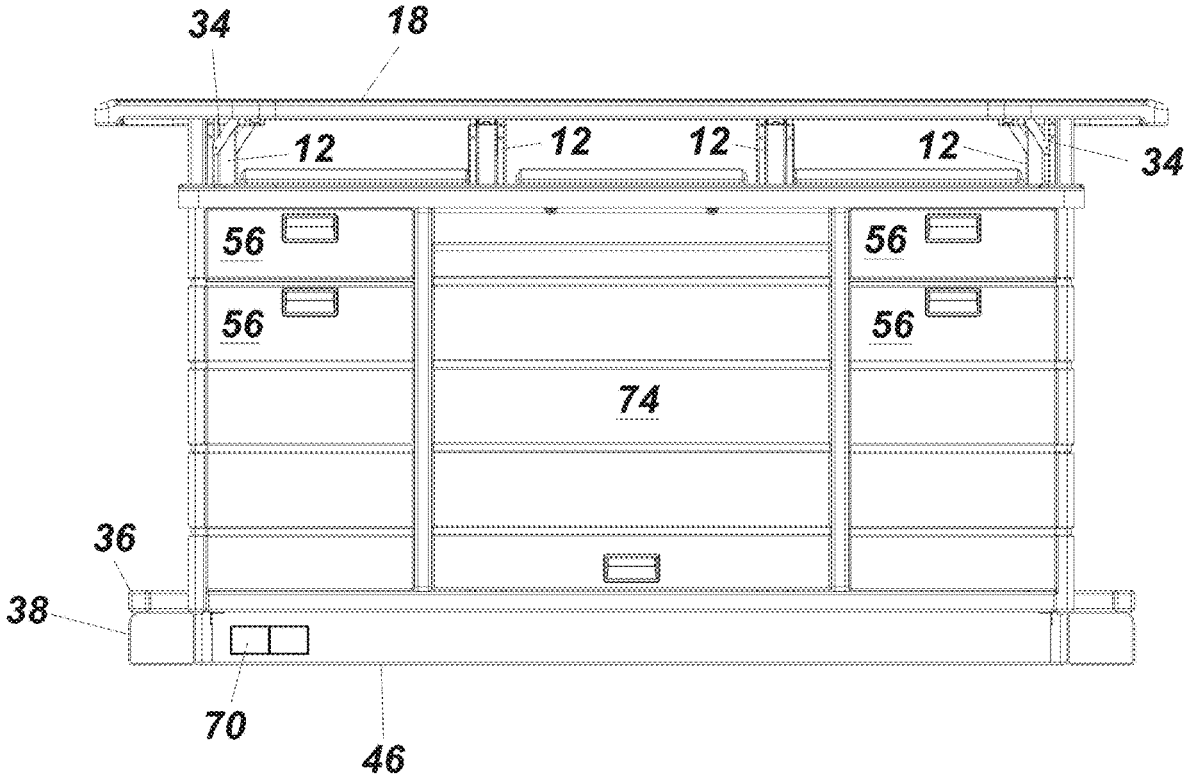
FIG. 4 is a rear view of the embodiment shown in FIG. 1.
Figure 5:
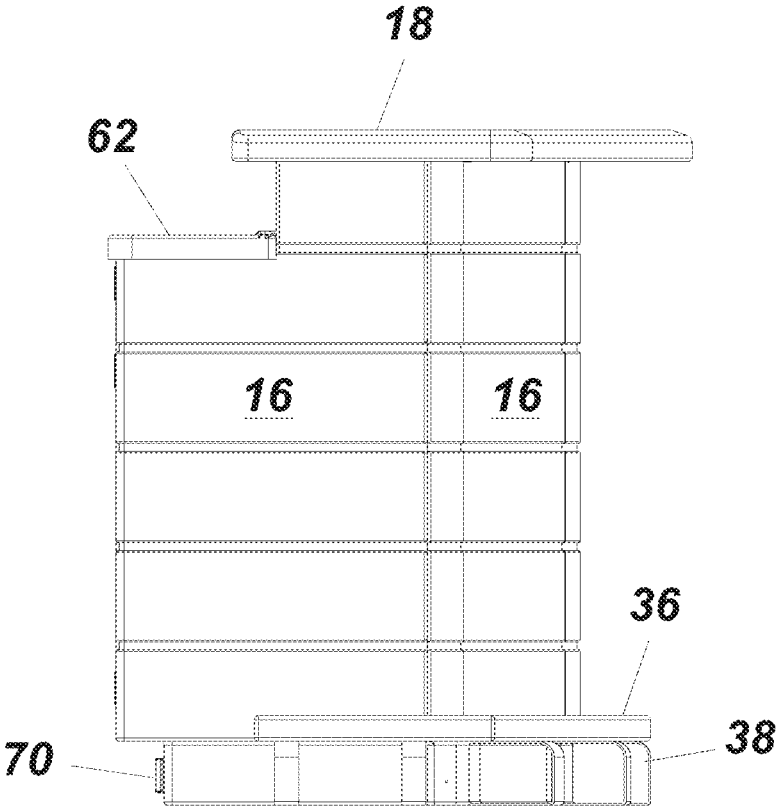
FIG. 5 is a left side view of the embodiment shown in FIG. 1.
Figure 6:
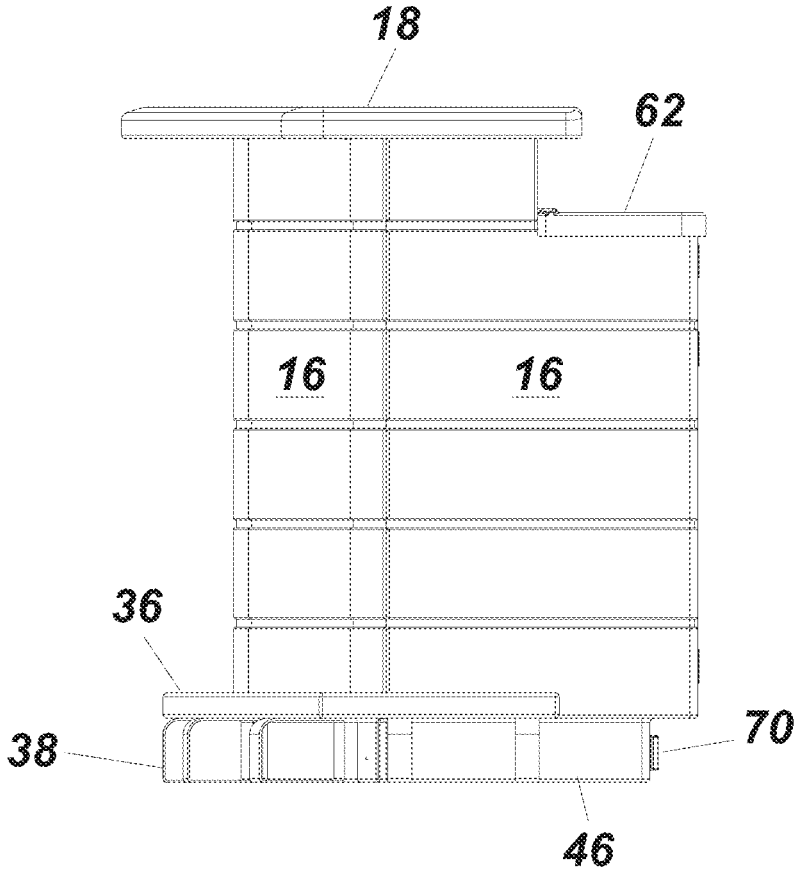
FIG. 6 is a right side view of the embodiment shown in FIG. 1.
Figure 7:
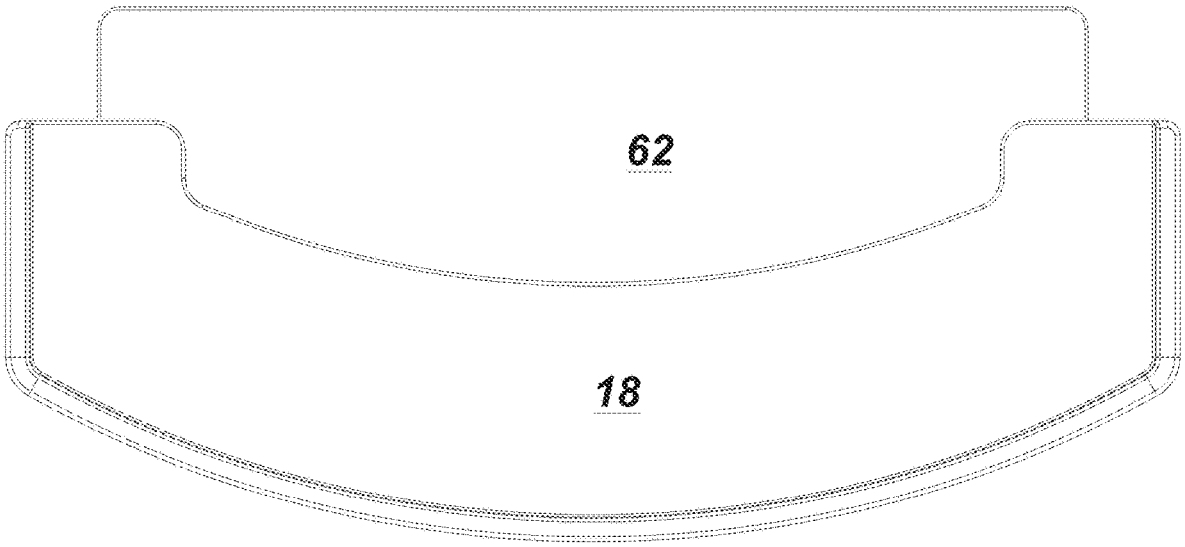
FIG. 7 is a top view of the embodiment shown in FIG. 1.
Figure 8:
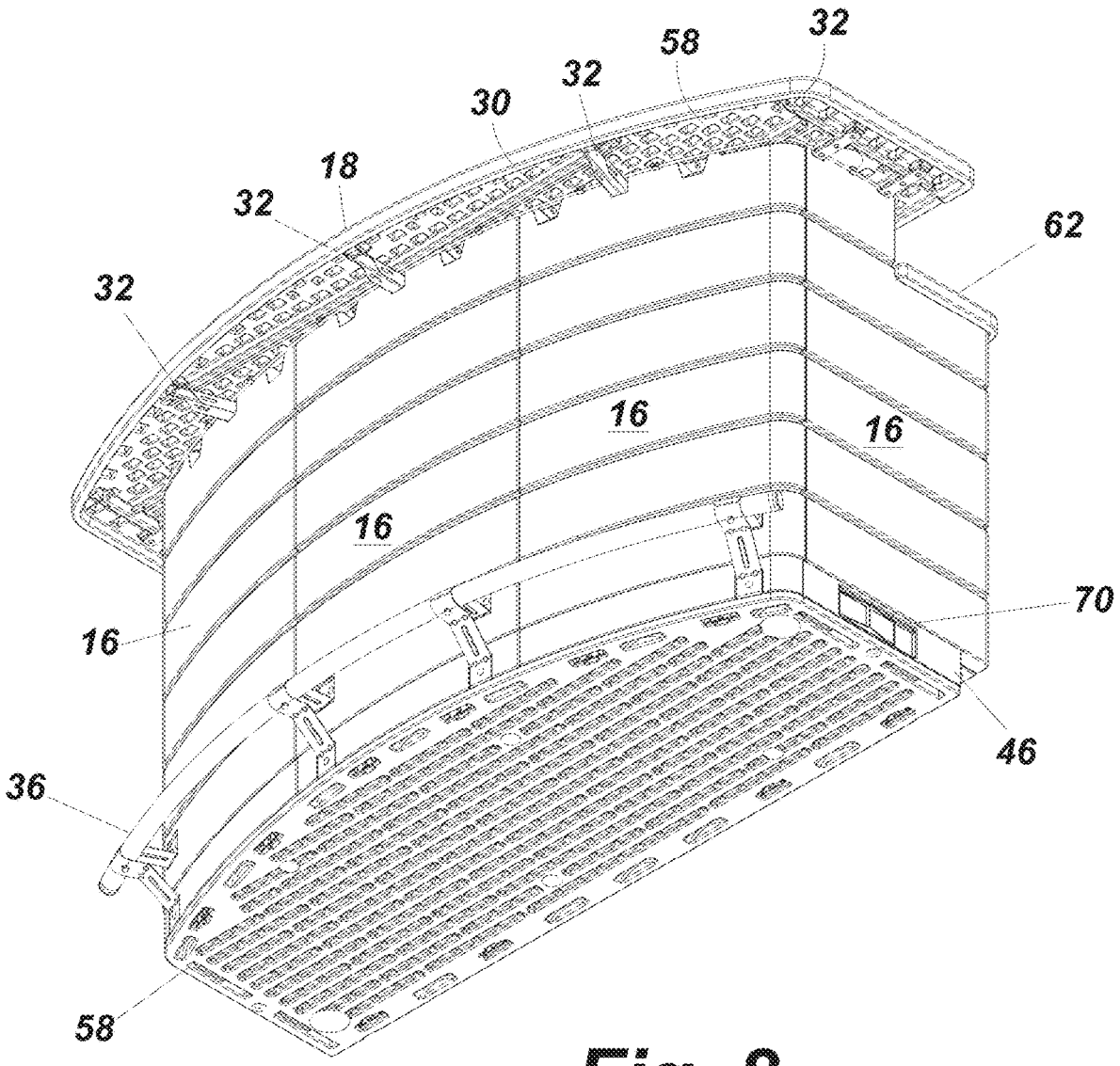
FIG. 8 is a bottom front right perspective view of the embodiment shown in FIG. 1.
Figure 9:
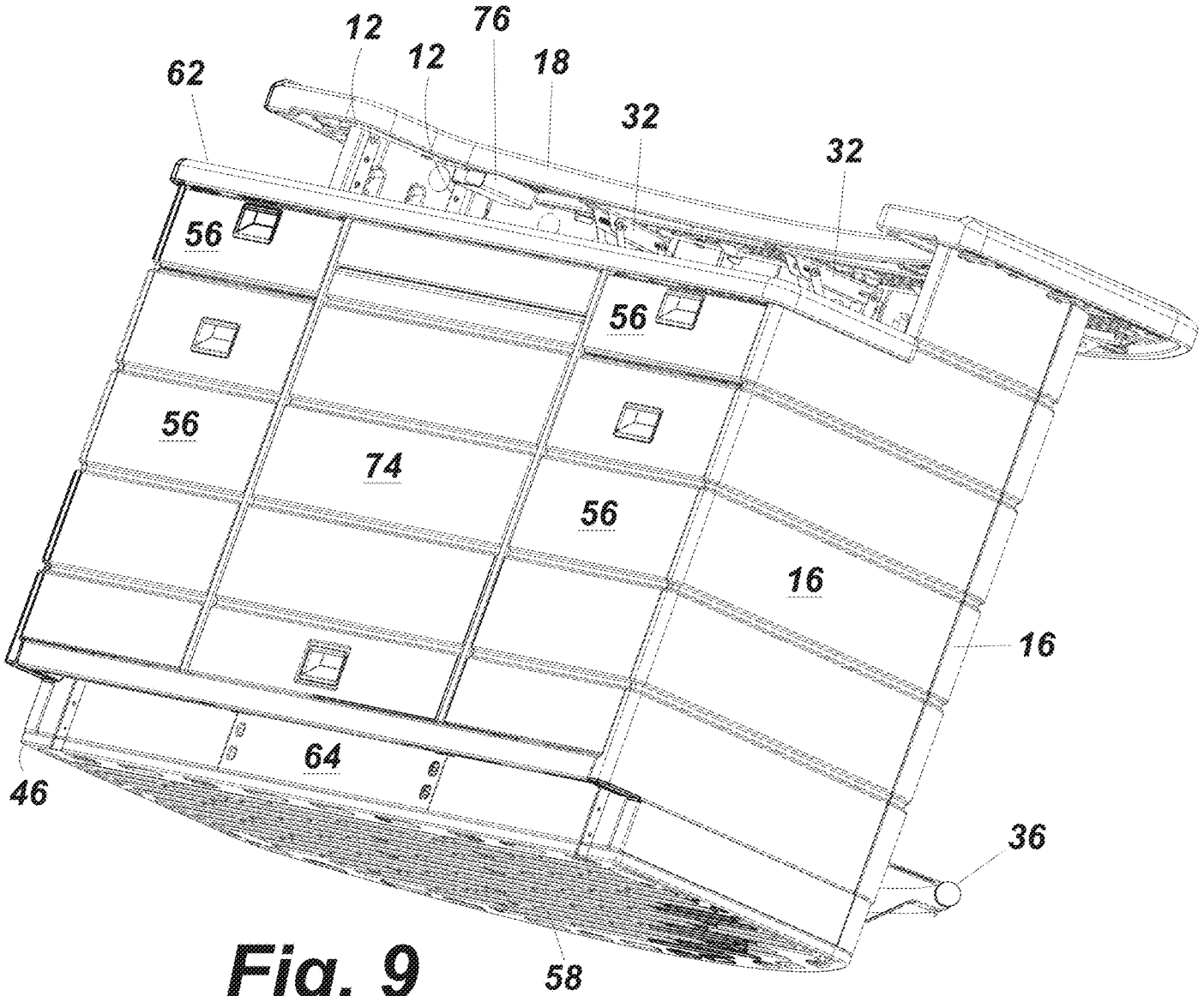
FIG. 9 is a bottom rear left perspective view the embodiment shown in FIG. 1.
Figure 10:
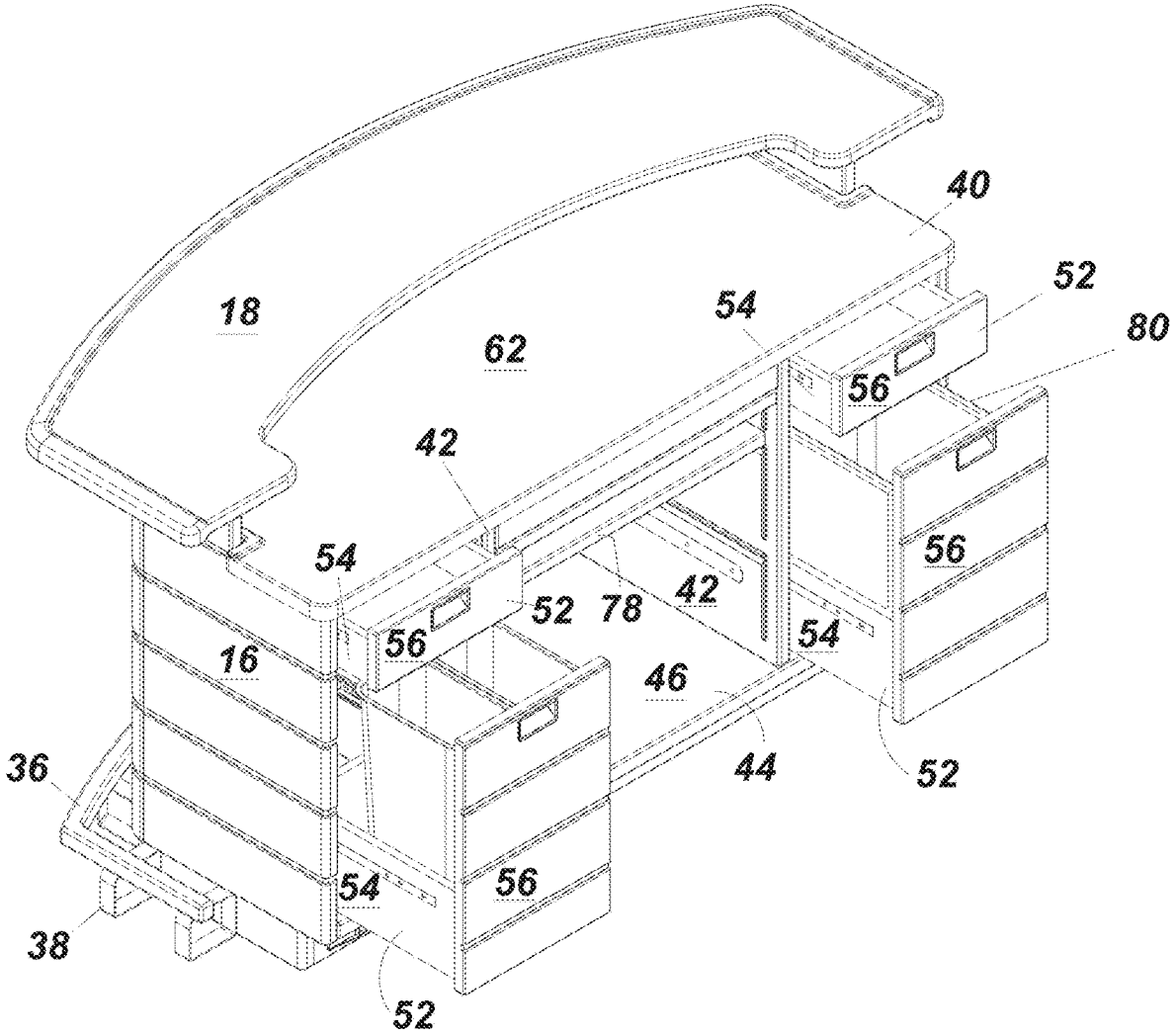
FIG. 10 is a top rear left perspective view illustrating drawers positioned in the rear of the present device.
Figure 11:
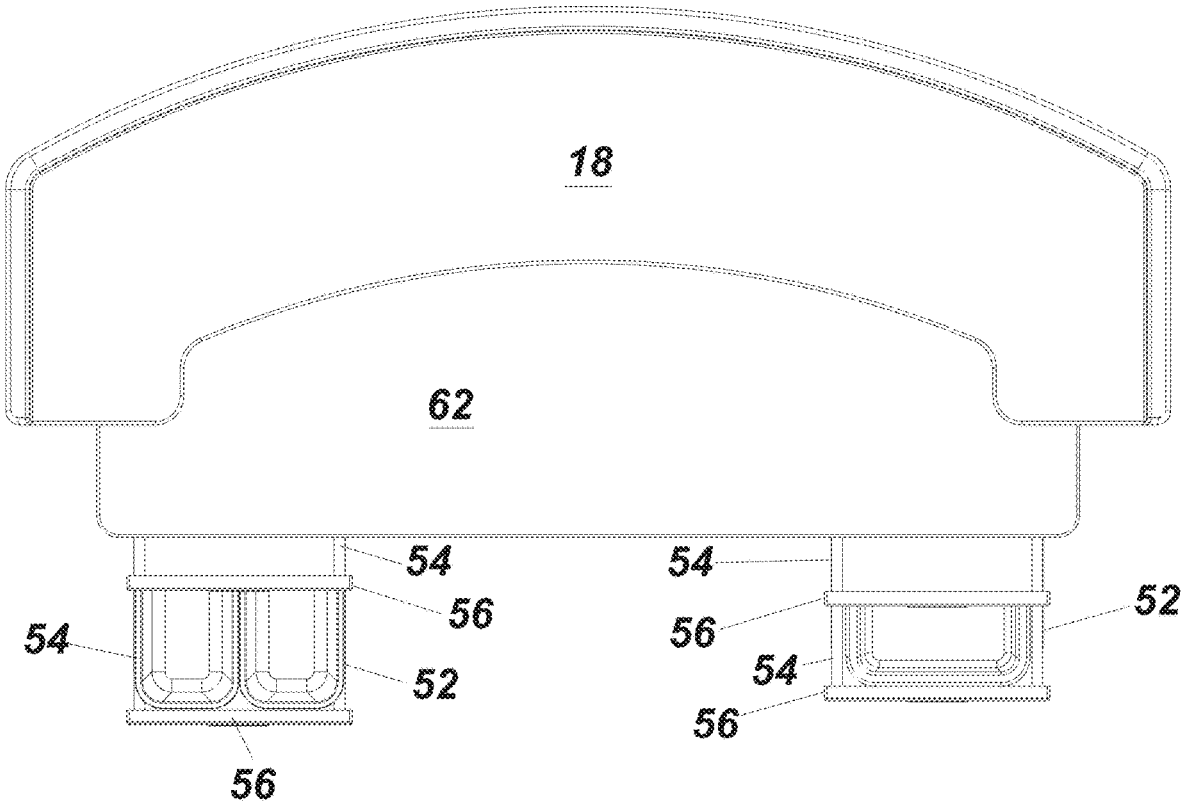
FIG. 11 is a top view illustrating the drawers of the present invention.
Figure 12:
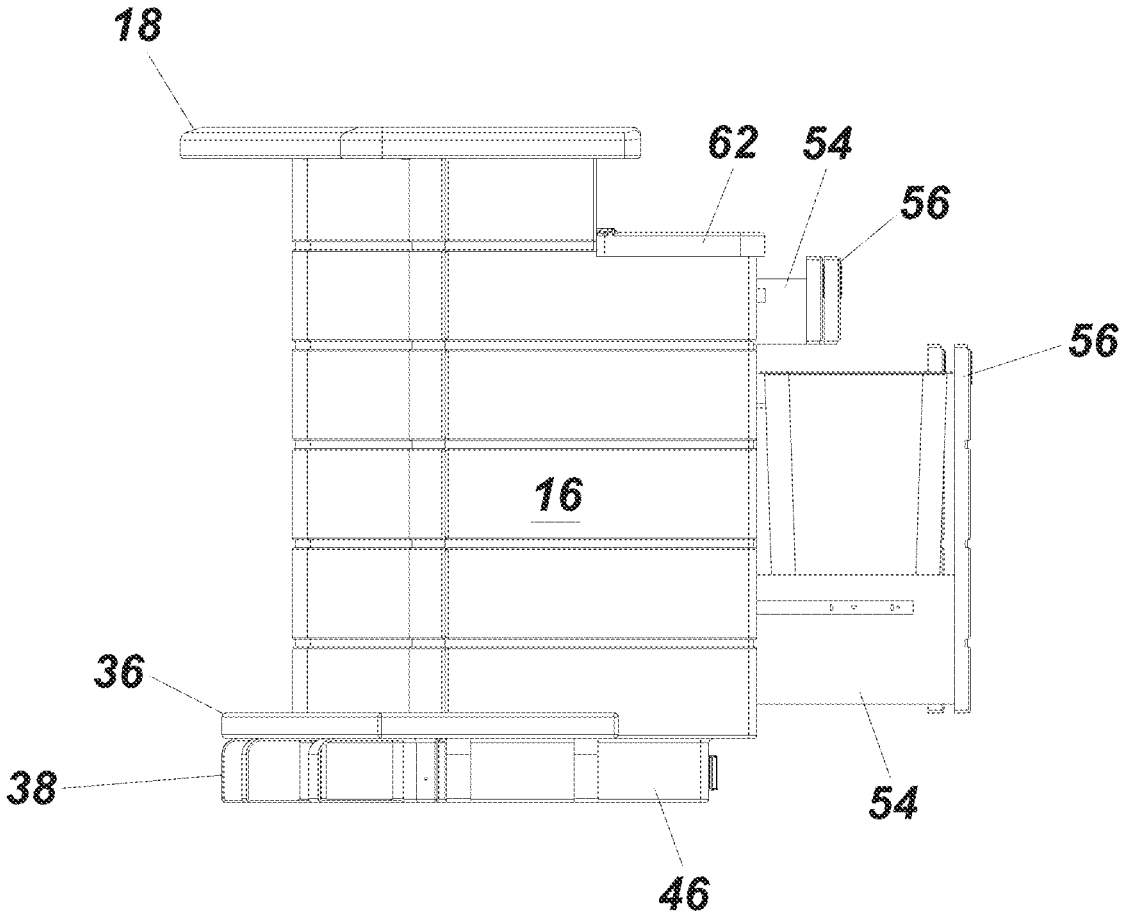
FIG. 12 is a left side view illustrating the drawers of the present invention.
Figure 13:
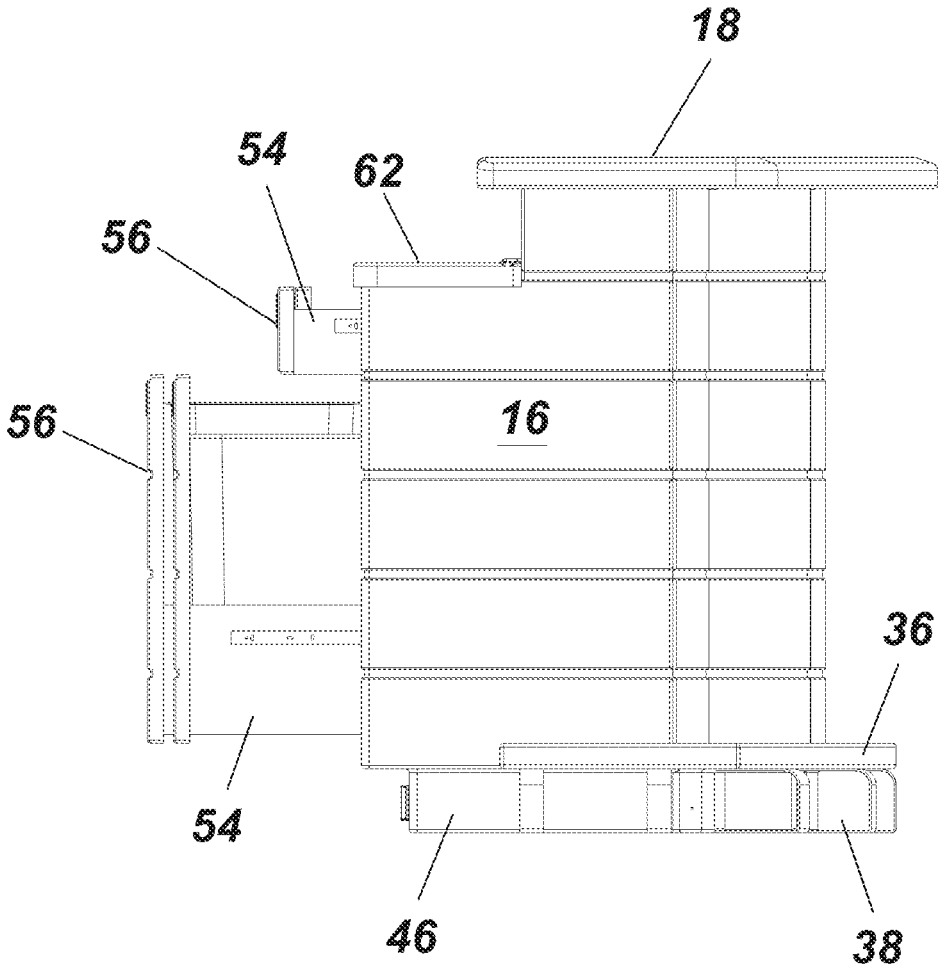
FIG. 13 is a right side view illustrating the drawers of the present invention.
Figure 14:
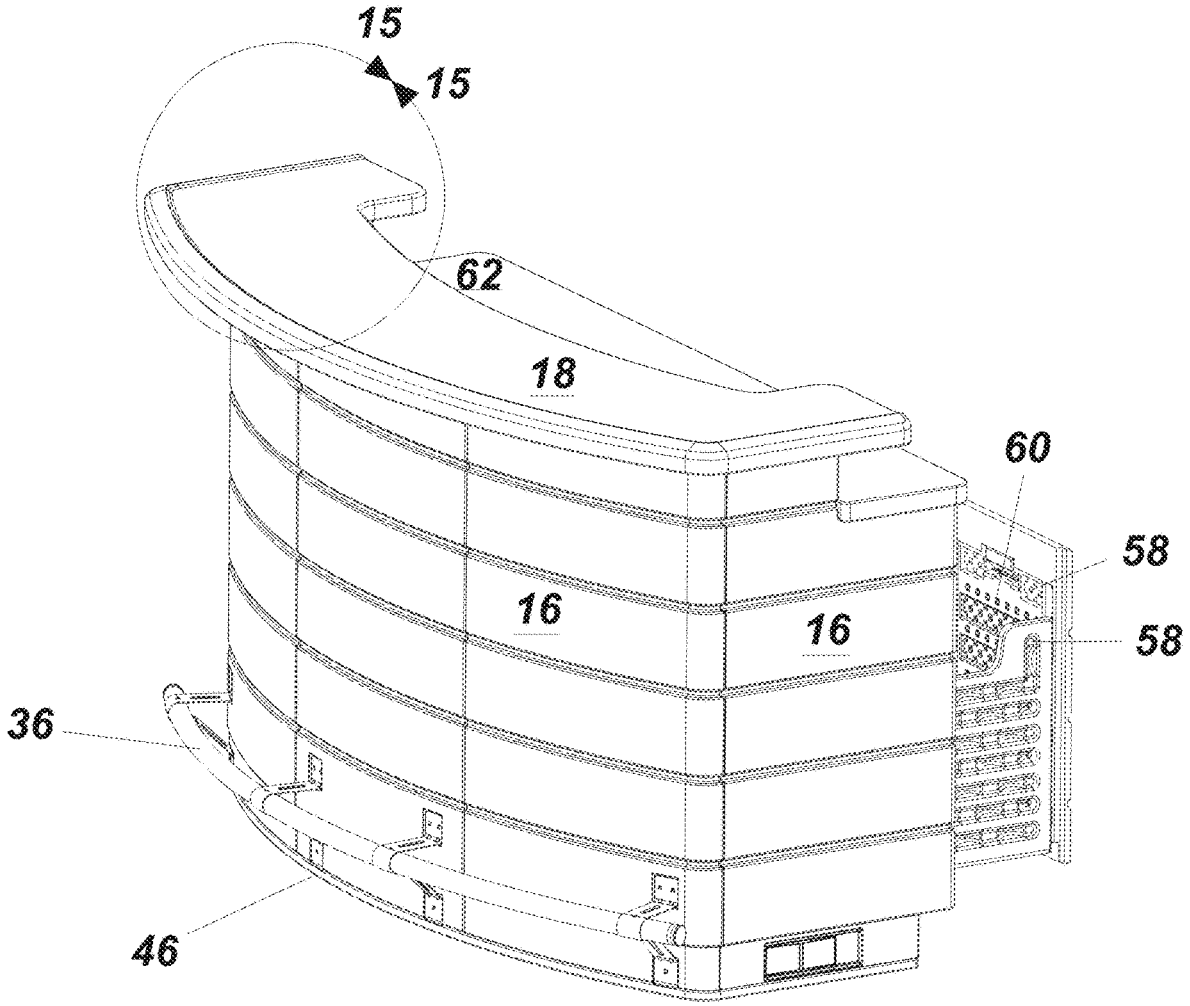
FIG. 14 is a top front right perspective view thereof illustrating the bar surface.
Figure 15:
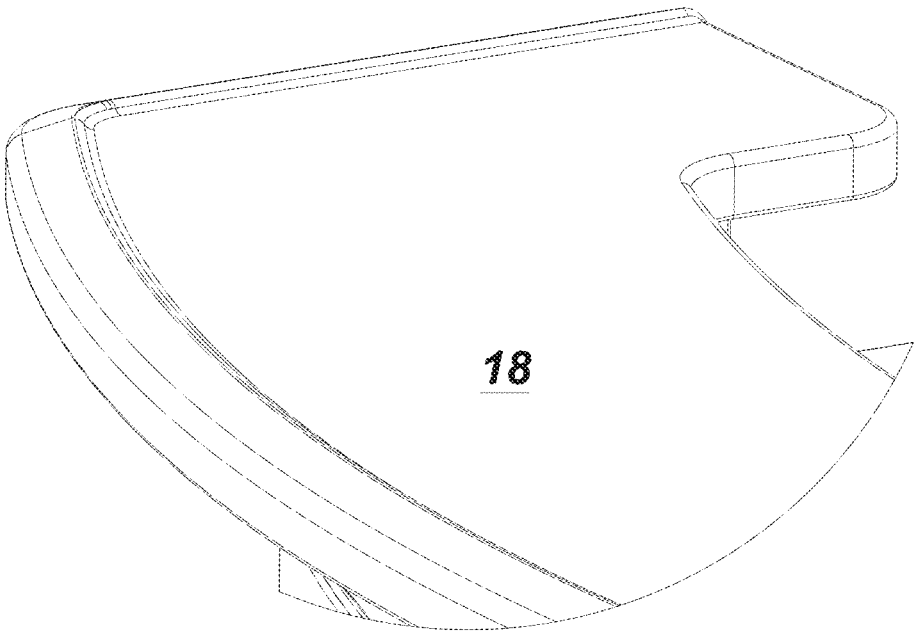
FIG. 15 is a partial enlarged view taken along lines 15-15 of FIG. 14 illustrating the construction of the bar surface.
Figure 16:
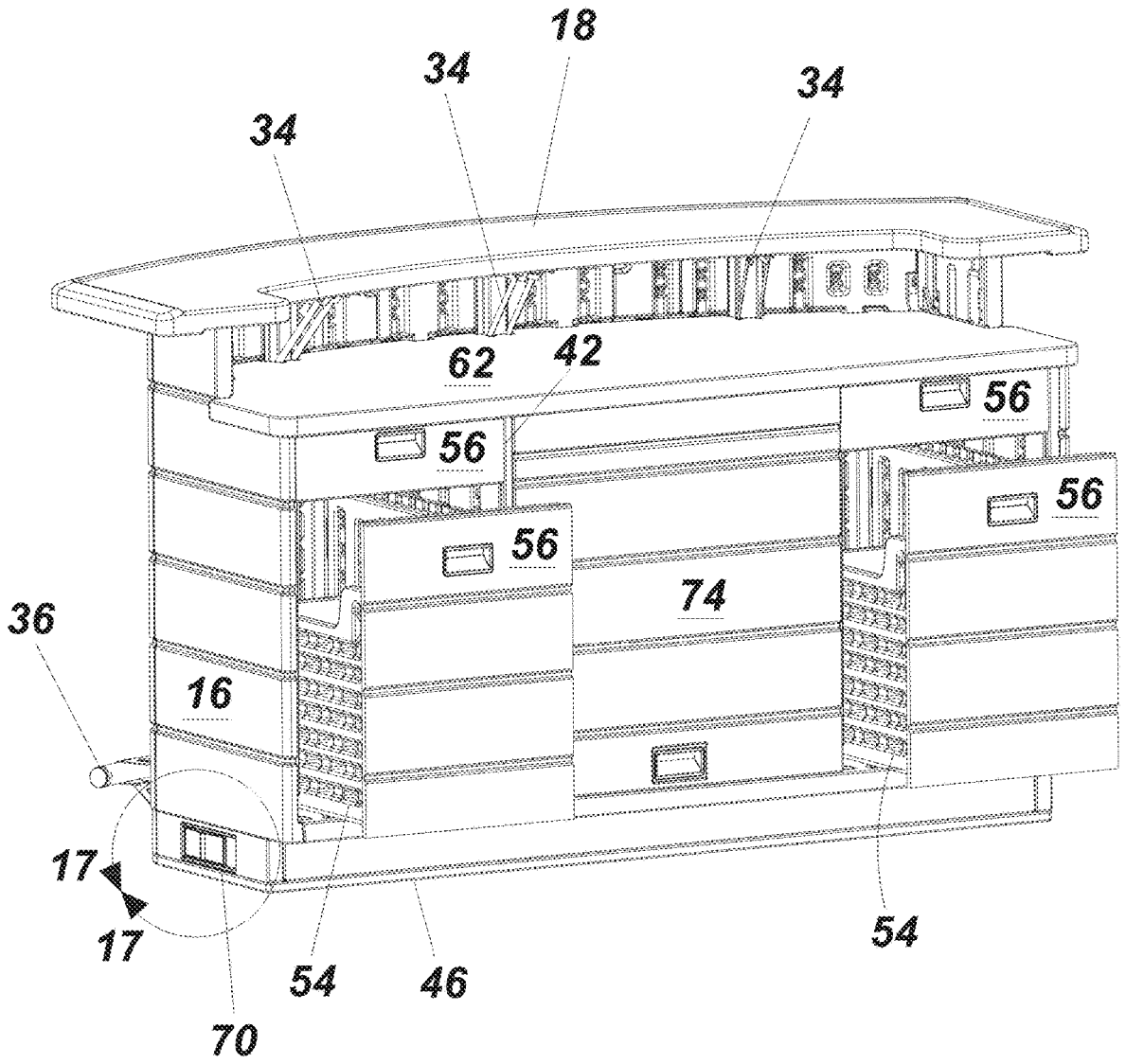
FIG. 16 is a top rear right perspective view thereof.
Figure 17:
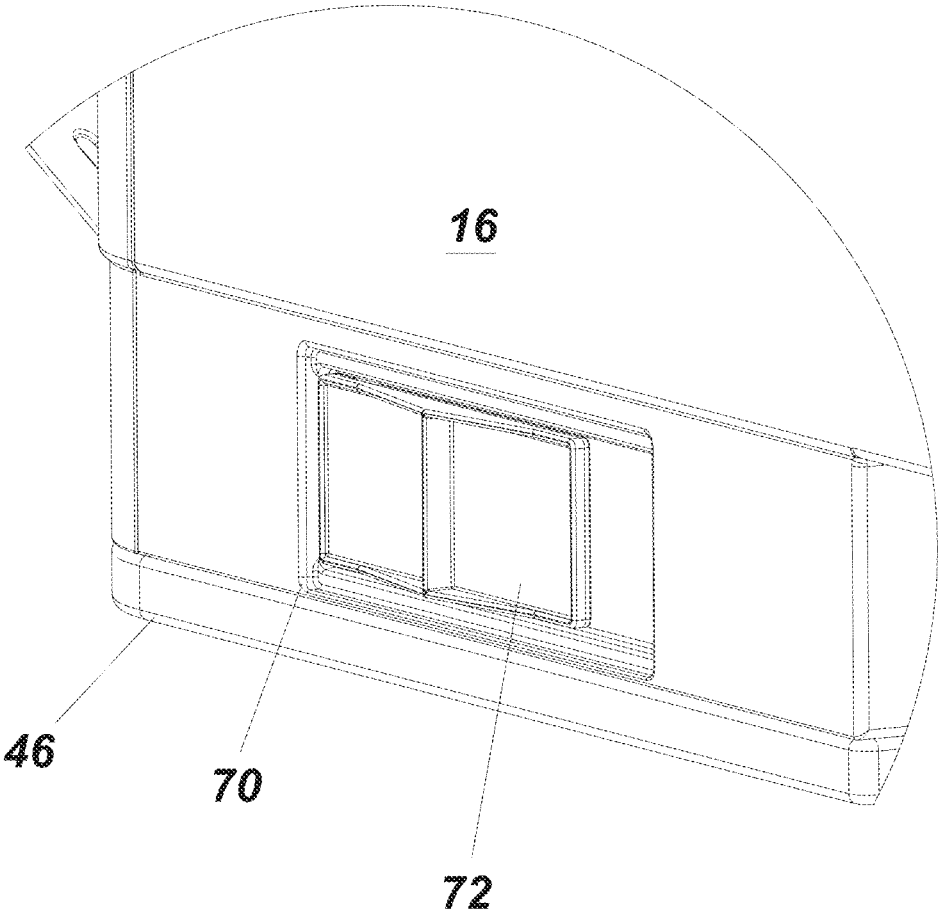
FIG. 17 is a partial enlarged view taken along lines 17-17 of FIG. 16, illustrating the electrical inlet port in a closed position.
Figure 18:
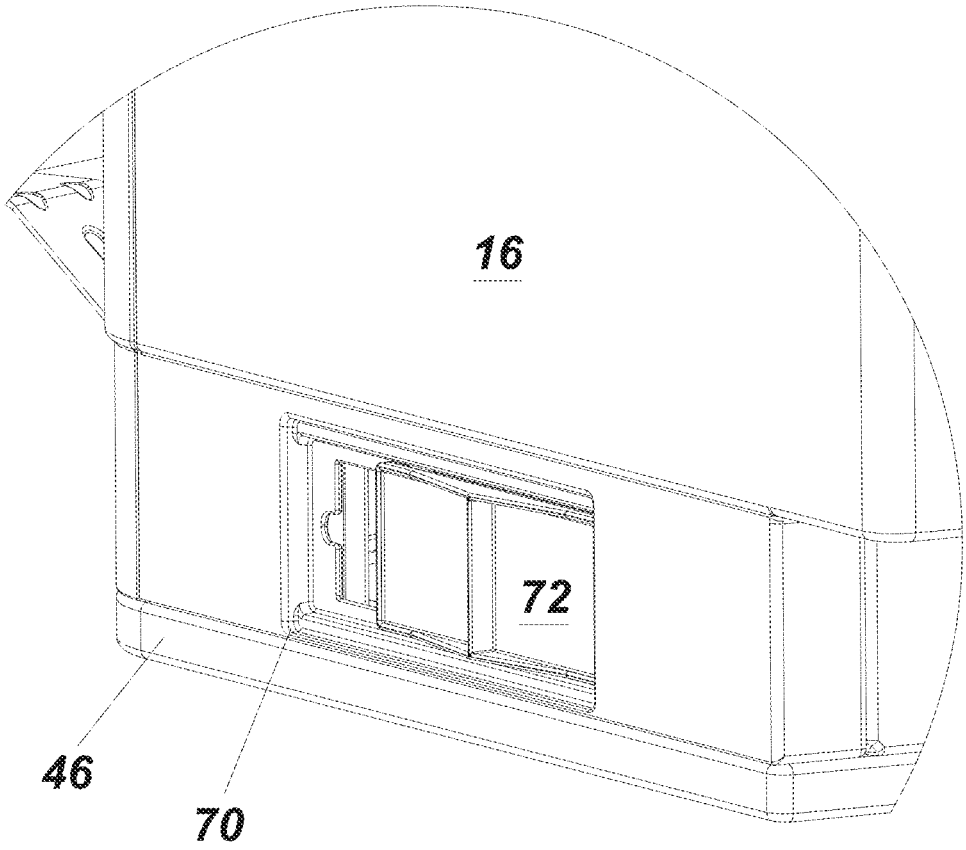
FIG. 18 is a partial enlarged view illustrating the electrical inlet port of FIG. 17 illustrated in an open position.
Figure 19:
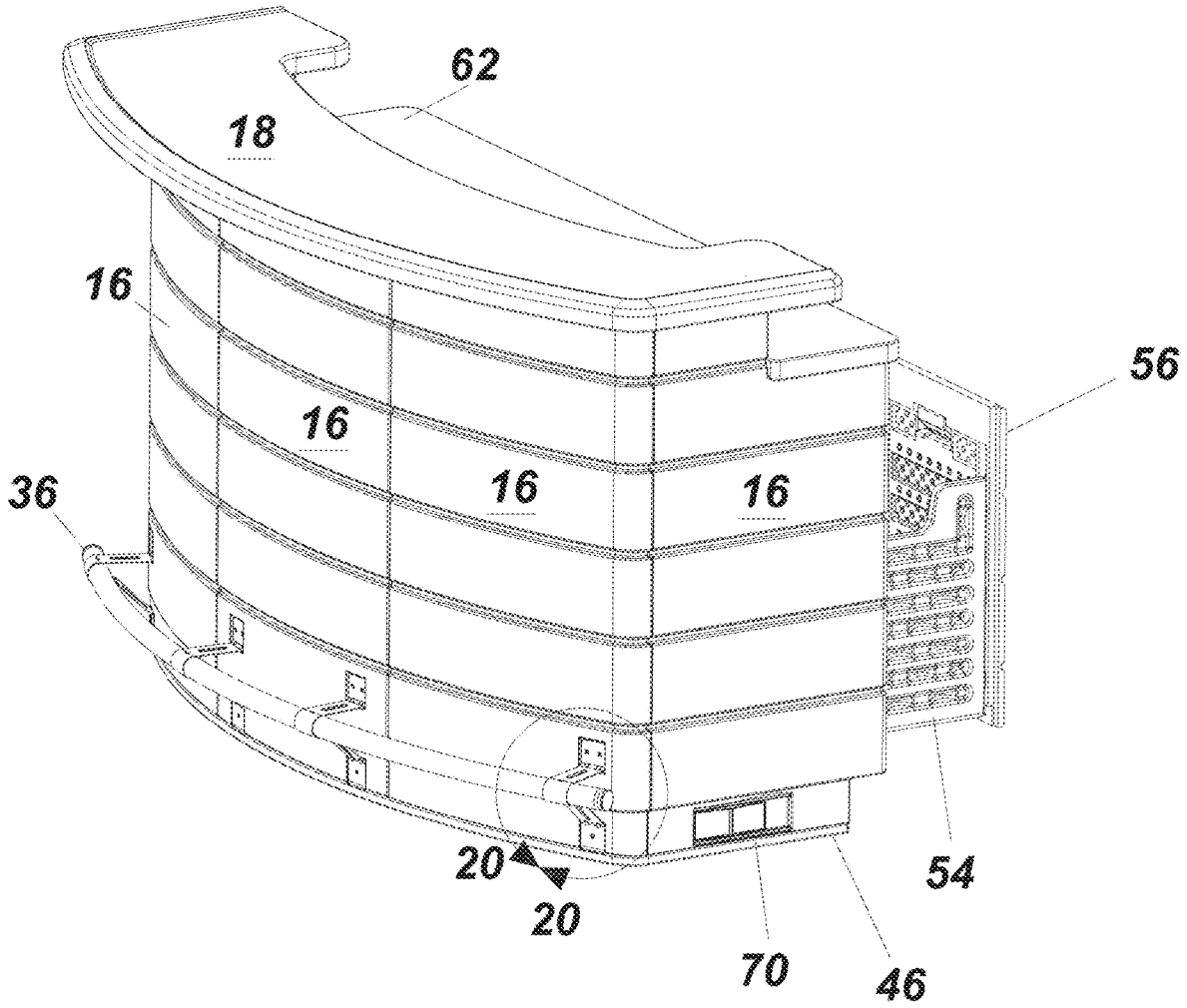
FIG. 19 is a top front right perspective view illustrating the foot rail of the present device.
Figure 20:
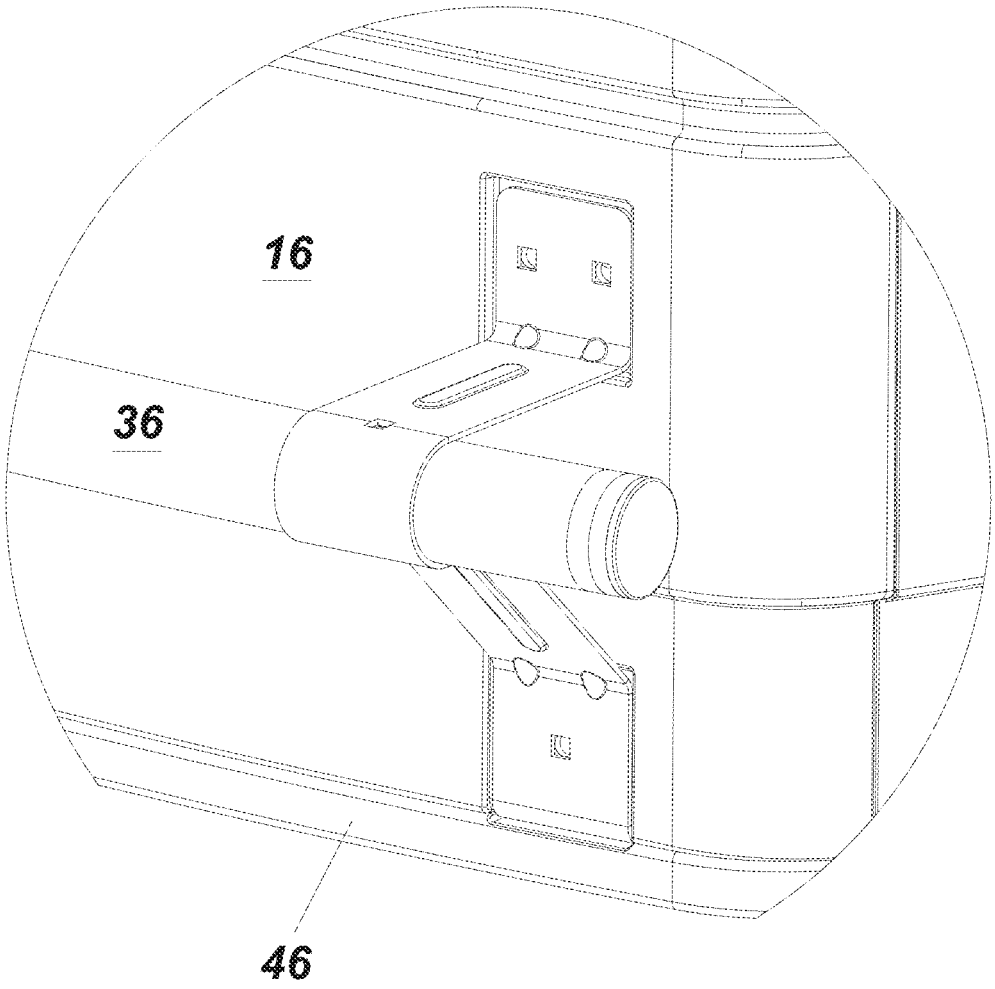
FIG. 20 is a partial enlarged view illustrating the foot rail mount of the present device.
Figure 21:
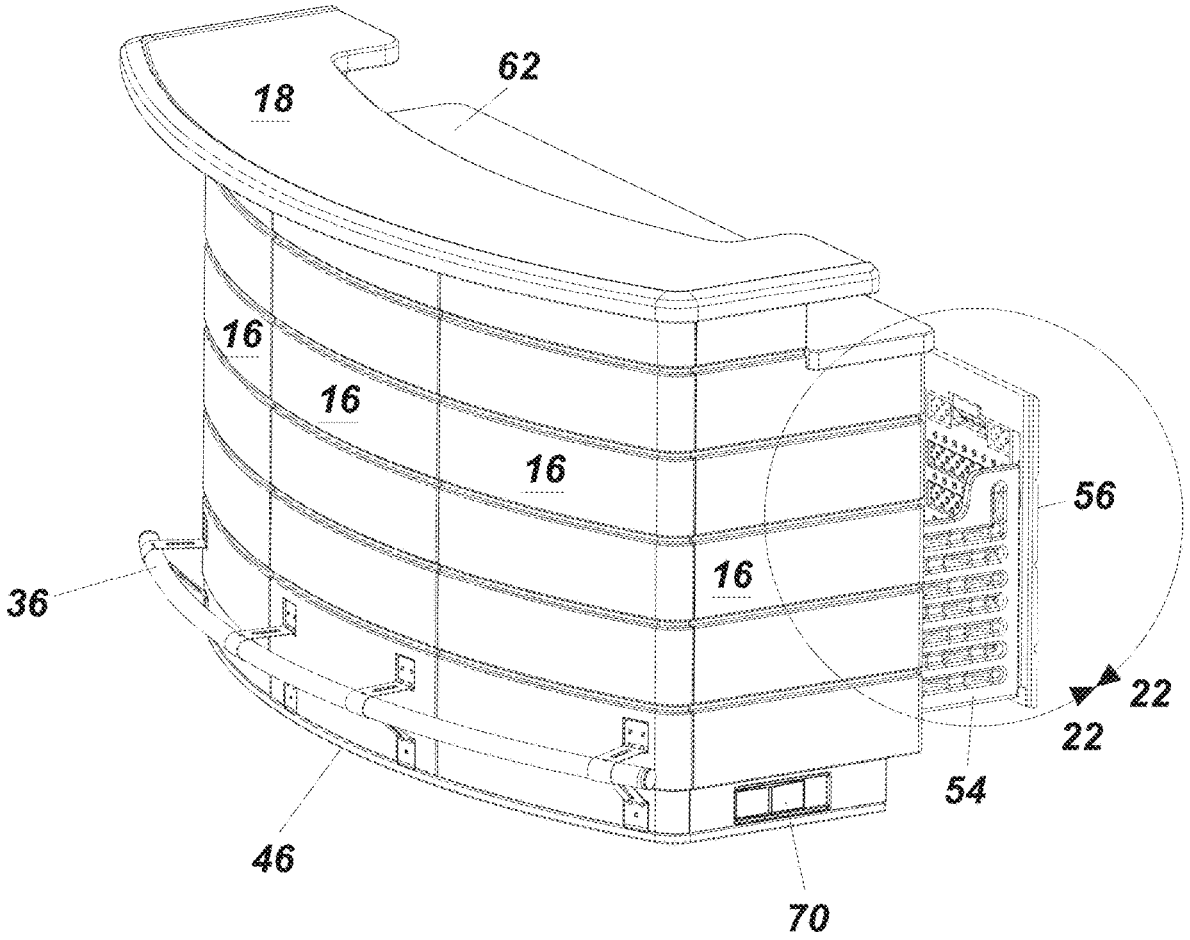
FIG. 21 is a top front right perspective view illustrating the drawer construction of the present device.
Figure 22:
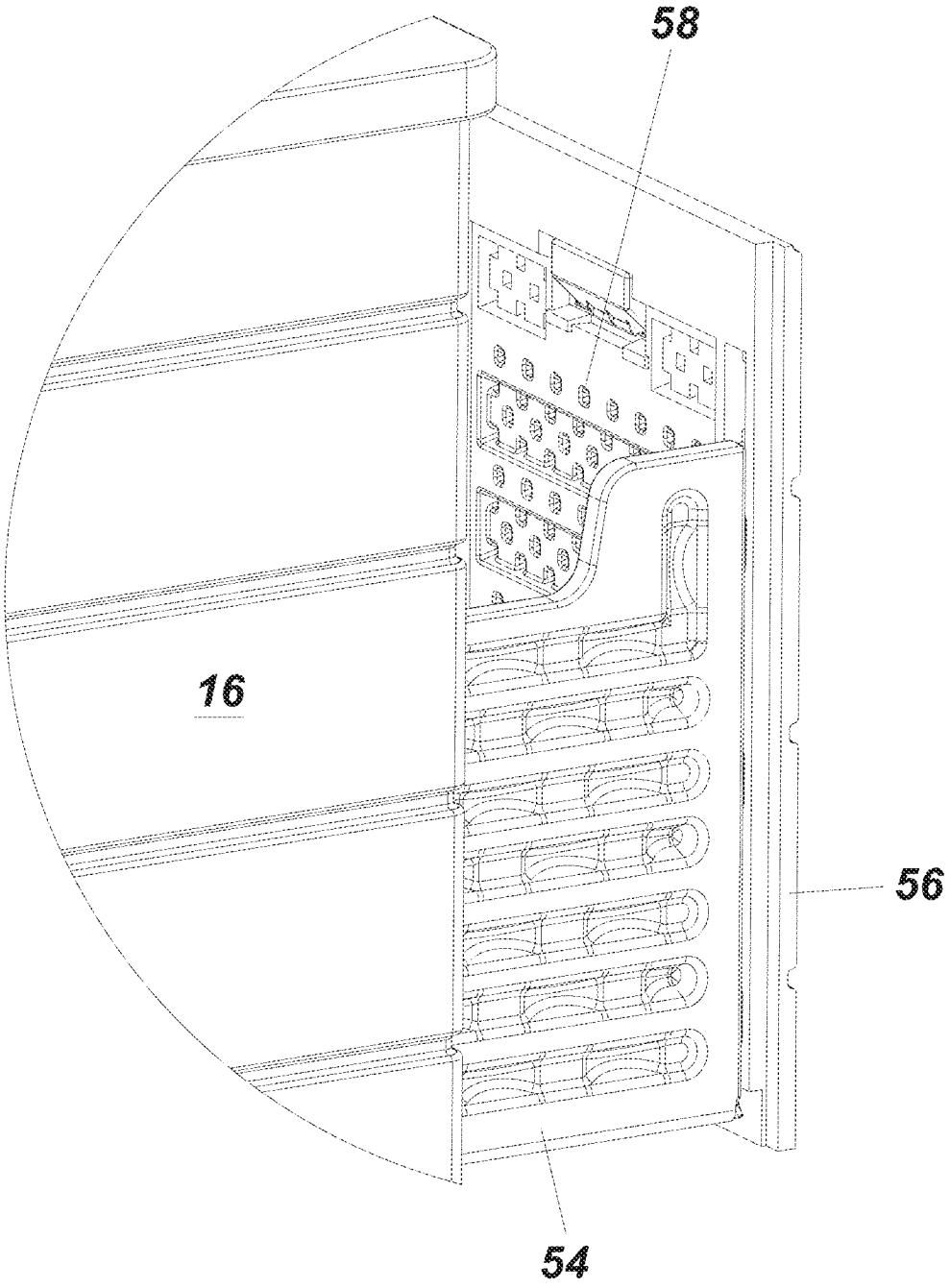
FIG. 22 is a partial enlarged view taken along lines 22-22 of FIG. 21 illustrating the tack-off and bead construction of the drawers.
Figure 23:
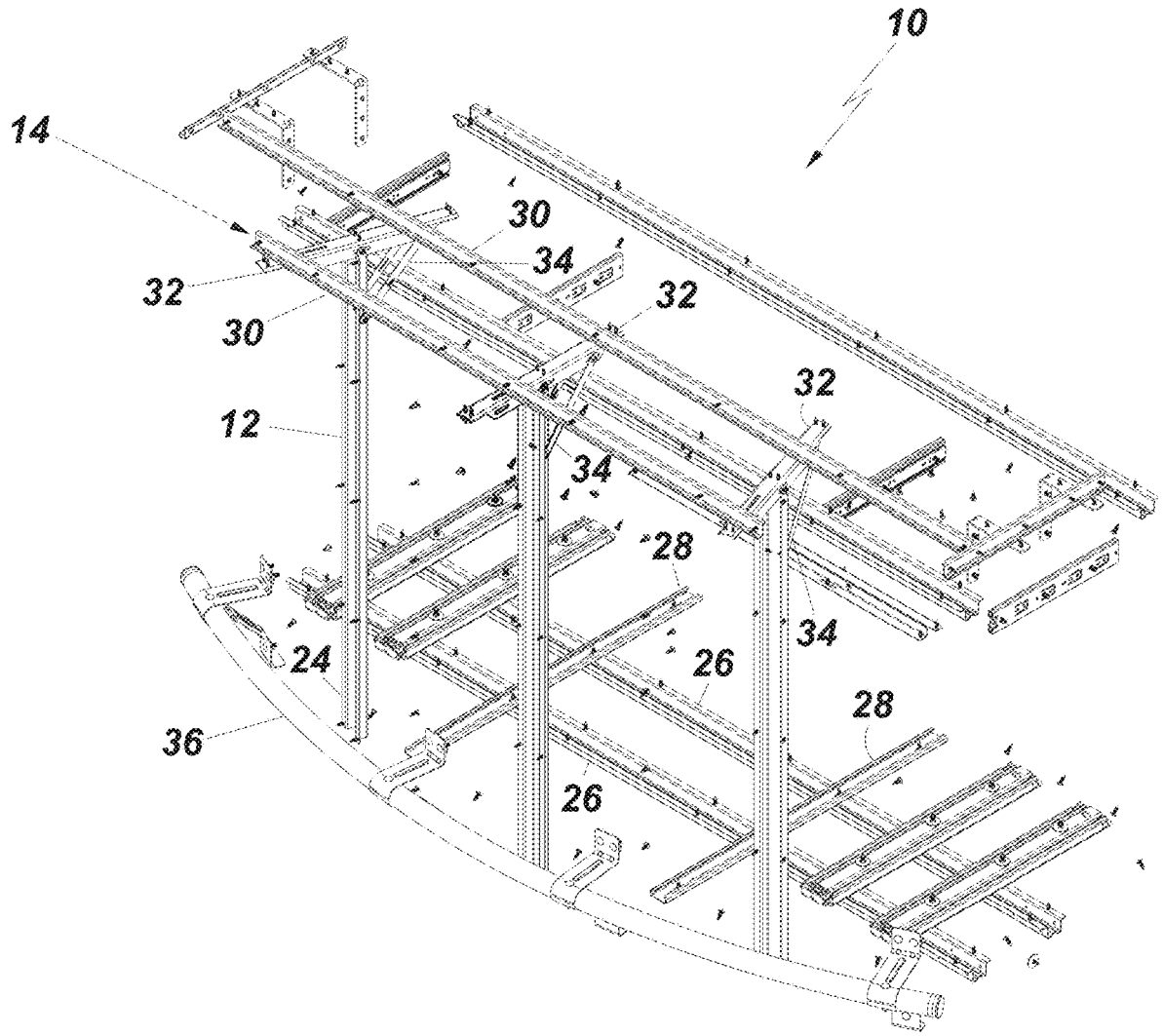
FIG. 23 is a top front right perspective view illustrating the metal space frame of the beverage service station and bar.
Figure 24:
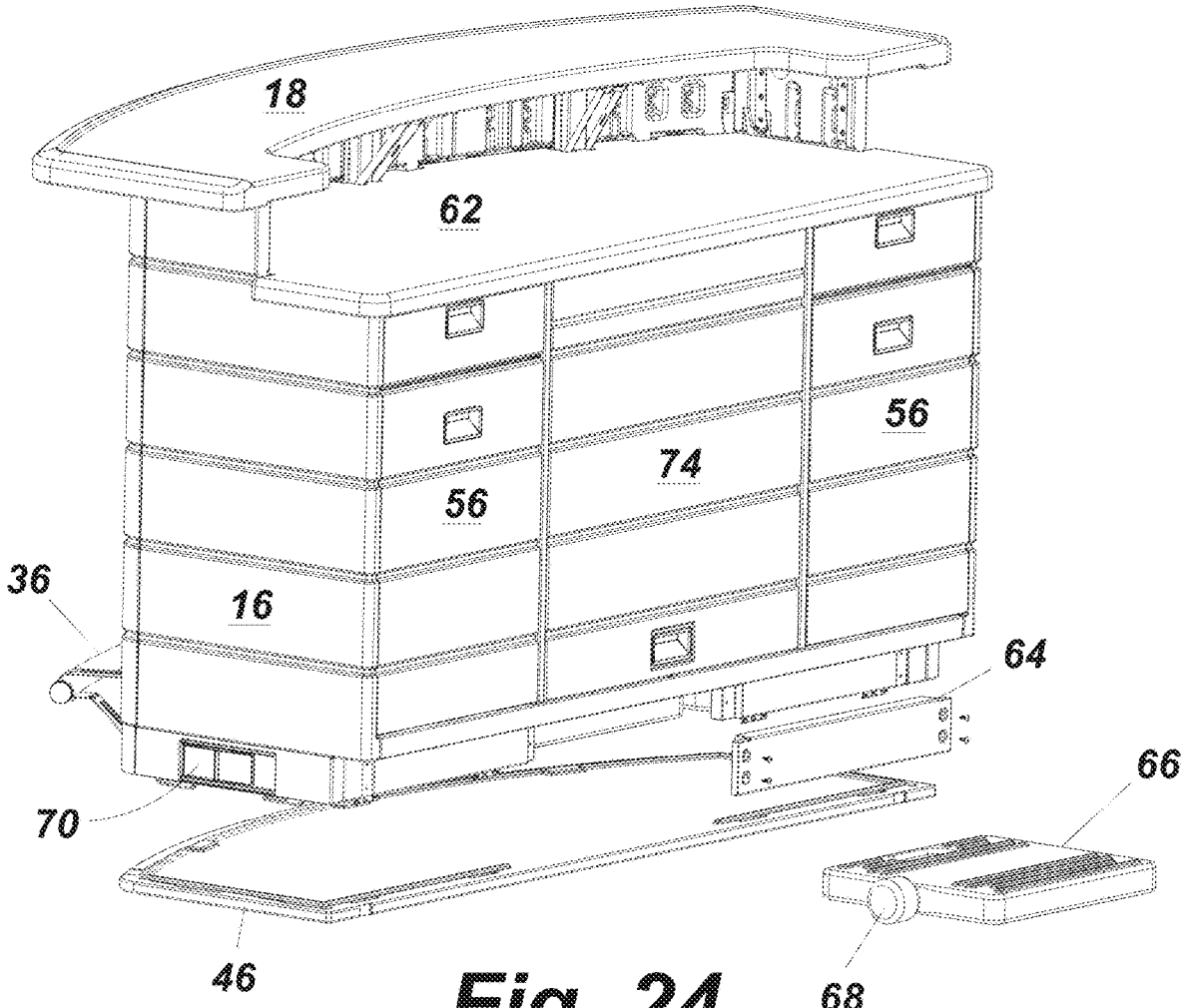
FIG. 24 is a top rear right perspective view illustrating the ballast tanks and ballast tank sockets.
Figure 25:
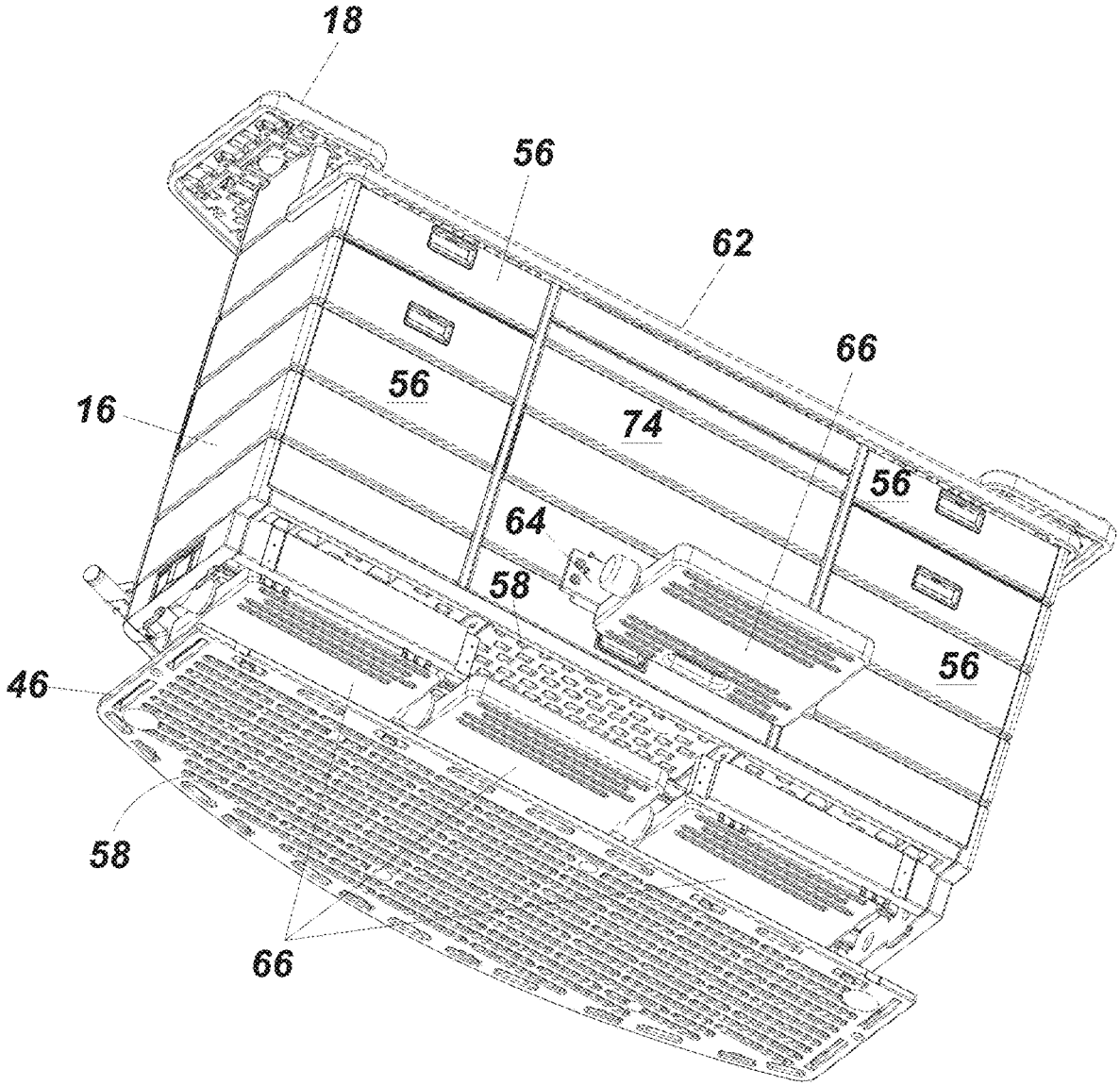
FIG. 25 is a bottom right rear perspective view illustrating the ballast tanks positioned within the ballast tank sockets.
Figure 26:
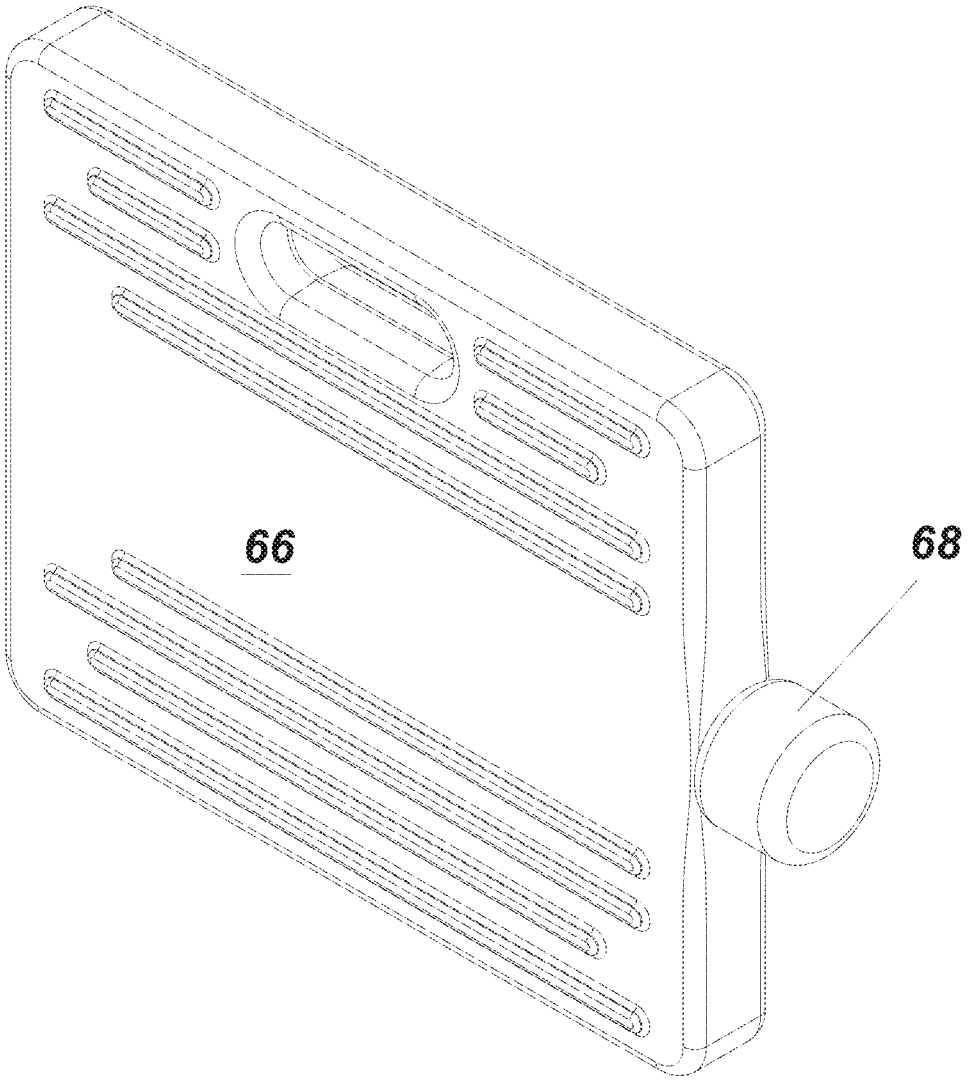
FIG. 26 is a top front right perspective view illustrating a ballast tank.
Figure 27:
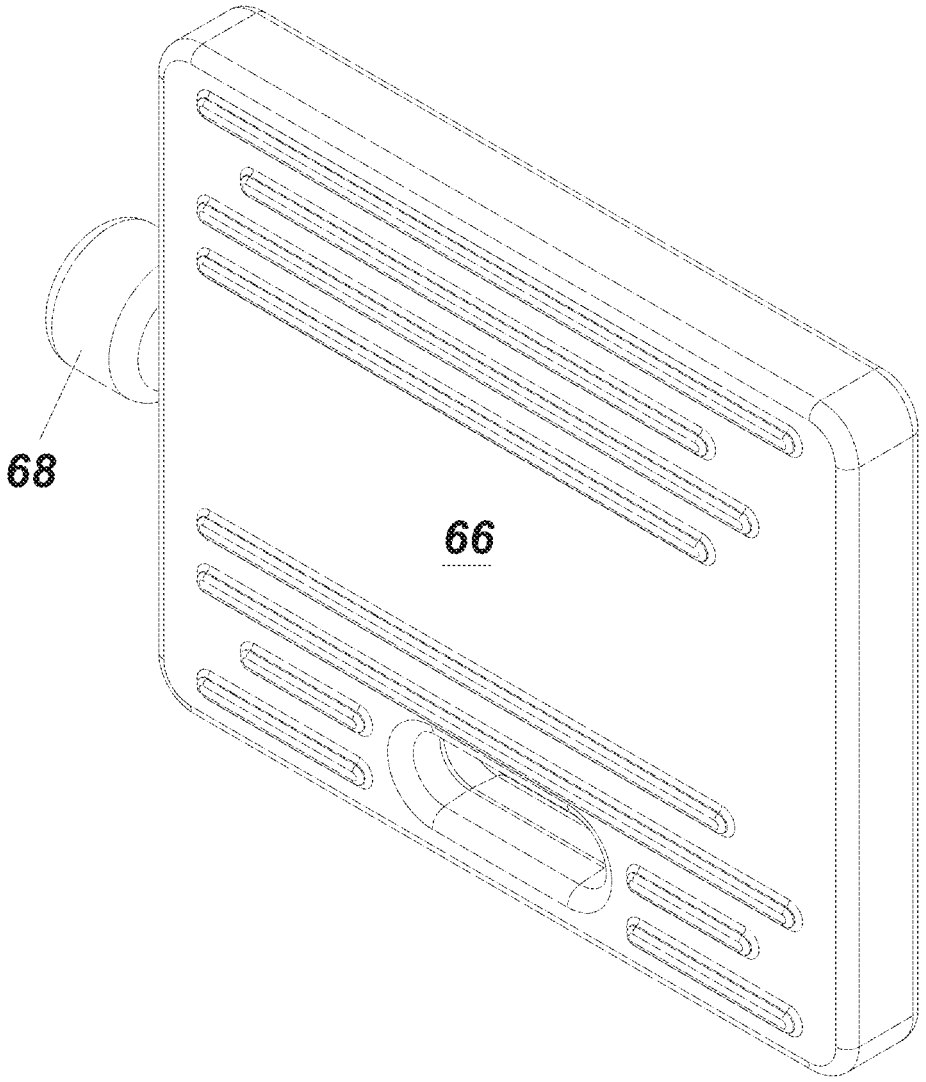
FIG. 27 is a bottom rear left perspective view of the ballast tank.
Figure 28:
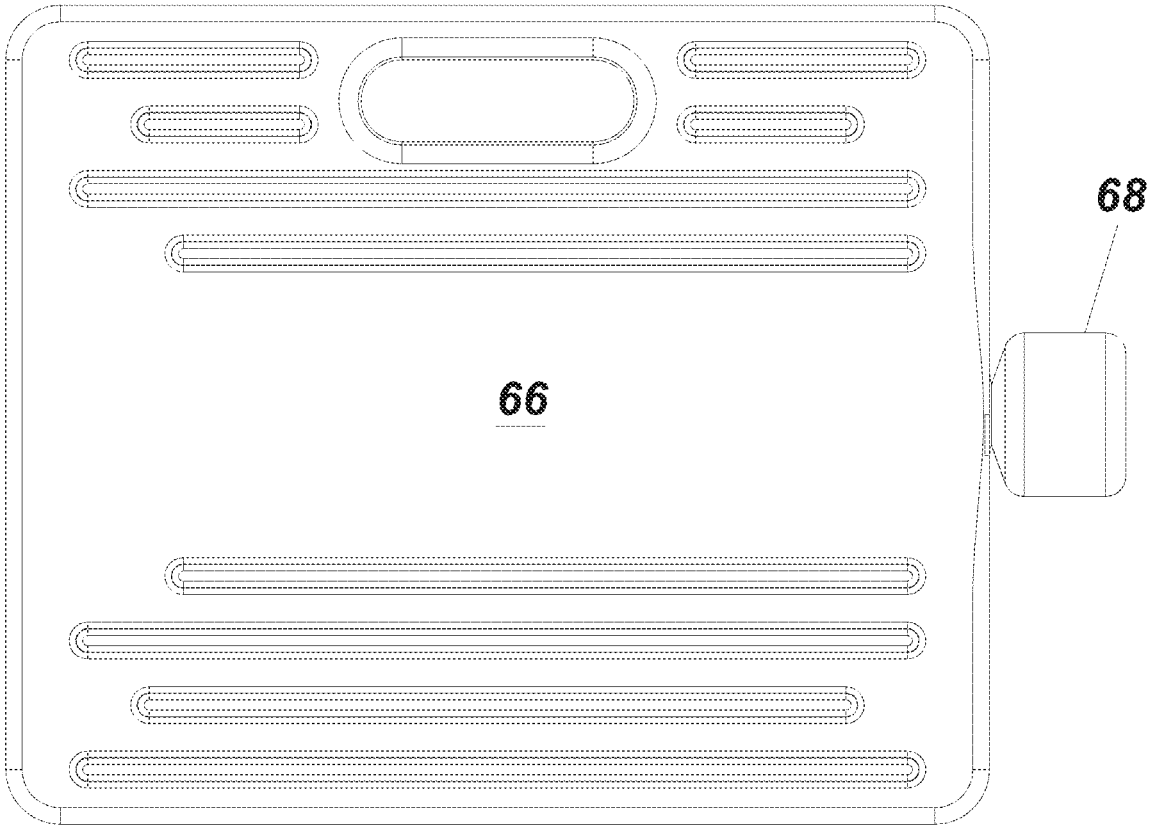
FIG. 28 is a front view of the ballast tank.
Figure 29:
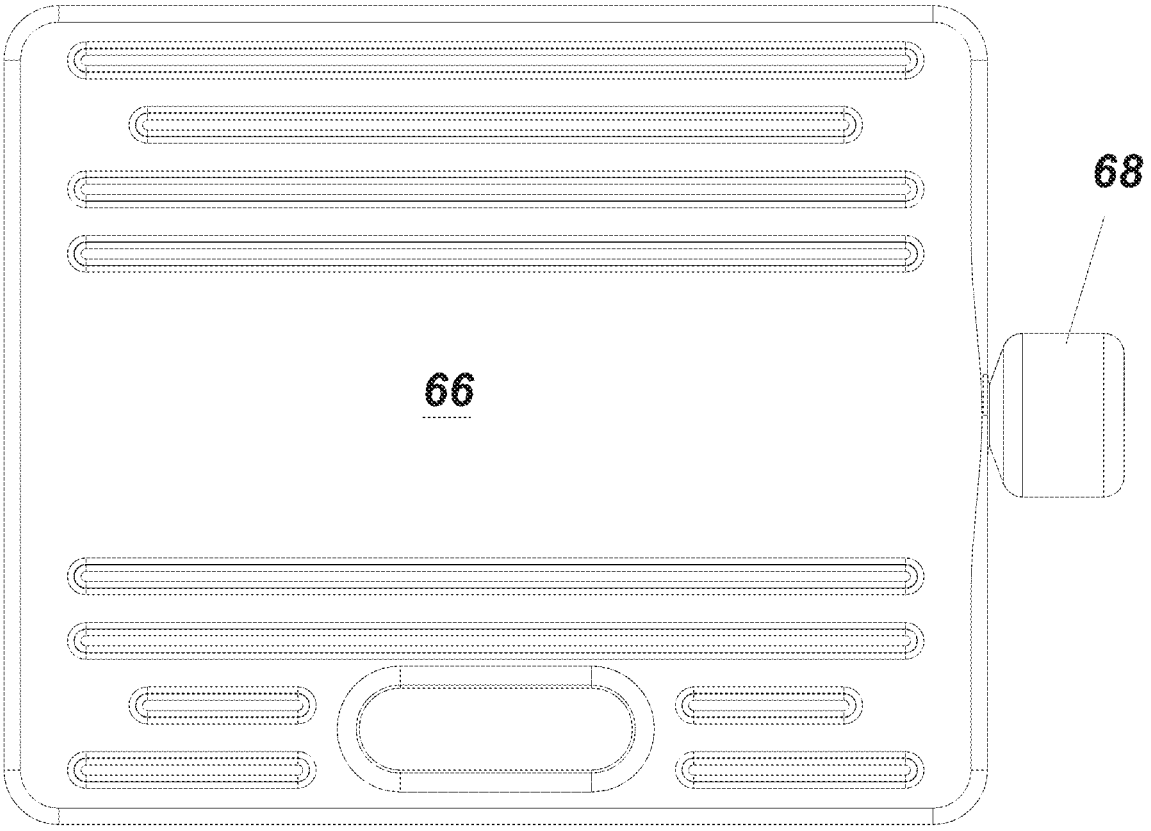
FIG. 29 is a rear view of the ballast tank.
Figure 30:
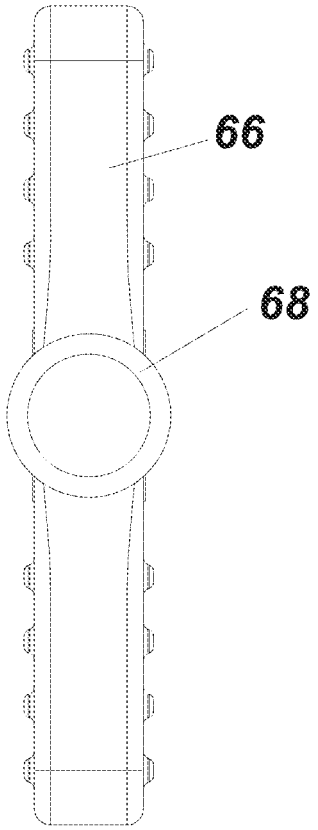
FIG. 30 is a right side view of the ballast tank.
Figure 31:
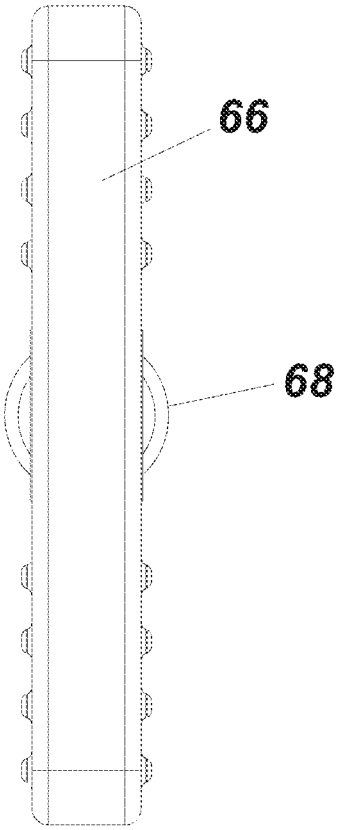
FIG. 31 is a left side view of the ballast tank.
Figure 32:
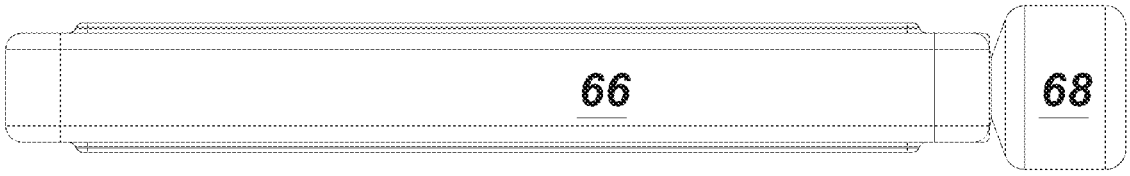
FIG. 32 is a top view of the ballast tank.
Figure 33:
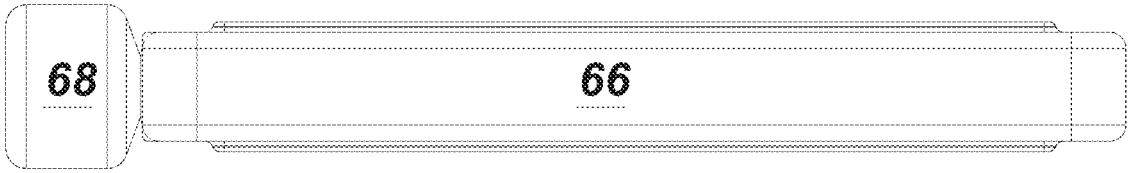
FIG. 33 is a bottom view of the ballast tank.

Referring generally to the figures and more specifically to FIGS. 1-25, a beverage station and bar 100 is illustrated. The beverage station and bar 100 includes a space frame 10, the space frame 10 being constructed to provide structure for the attachment of interlocking outer panels 16, the space frame 10 forming a load bearing structure constructed and arranged to transfer loads to other portions of the space frame 10 to increase weight capacity and rigidity to the beverage station and bar 100. A bar panel 18 is secured to a spine portion 14 of the space frame 10 such that loads applied to the bar panel 18 are transferred through the space frame 10 and distributed to other portions of the beverage station and bar 100. A preparation panel 62 is positioned slightly below and substantially parallel to the bar panel 18 for prepping food and drinks before being served on the bar panel 18. A plurality of interlocking panels 16 are interlocked at least along the edges and secured to a plurality of rib members 12, while the rib members 12 are secured to the spine portion 14 of the space frame 10. This construction creates a hybrid structure that is lightweight and moveable yet is sufficiently stable for use as a serving station and bar 100. The interlocked panels 16 create a box type structure that is secured around the space frame 10 to provide weight transfer, rigidity, and stability against twisting and flex of the structure.

Still referring to the figures, in a most preferred embodiment, the spine portion 14 is oriented to be horizontal with respect to a ground surface, and wherein the ribs 12 are oriented to be vertical with respect to a ground surface. The spine 14 includes at least two beams 30 and at least two cantilever beams 32. Each cantilever beam 32 includes a balance beam 34, the balance beam 34 constructed and arranged to transfer unbalanced loads applied to the cantilever beams 32 to the rib members 12 as a torque. In this manner, dynamic and static loads applied to the bar panel 18 are transferred through to the space frame 10 where the load is dispersed without damaging the bar panel 18 or the construction of the bar 100. In at least one embodiment, the space frame 10 includes a base assembly 22 secured to a bottom portion 24 of the ribs 12. The base assembly 22 includes a cross grid comprising at least two longitudinal members 26 and at least two cross members 28, the longitudinal members 26 and the cross members 28 secured together in a suitable manner to transfer load from the ribs 12 to the base assembly 22, and thus to the surface below the beverage station and bar 100.

Still referring to the figures, the beverage station and bar 100 preferably includes a plurality of support panels 42 positioned to extend rearward from the ribs 12, the support panels 42 extending vertically from a top surface 44 of a base panel 46 to a bottom surface 48 of a preparation surface 40, the preparation surface 40 positioned to be below the bar panel 18 and oriented parallel thereto. At least one span beam 50 is provided; the span beam 50 secured to the bottom surface 48 of the preparation surface 40 and supported on an upper surface of the support panels 42. The spacing of the support panels 42 not only provides structural support for the preparation surface 40, but they are spaced apart to accommodate drawers 52, and may accommodate mini refrigerators, trash containers and the like. In the preferred embodiment, the drawers 52 are constructed from hollow blow molded drawer side panels 54 and hollow blow molded face panels 56; and in a most preferred embodiment, each blow molded panel, including the base panel 46, bar panel 18, preparation panel 62, and outer panels 16 are constructed to include a plurality of tack-offs 58 to add rigidity to the hollow panel. The tack-offs 58 are positioned in rows and columns to provide additional rigidity and weight capacity to the hollow structure. In this manner, the panels can be constructed hollow for weight reduction while still retaining significant structure and rigidity. In some embodiments, a ballast panel 64 is provided to allow a ballast container 66 to be placed within the base portion of the beverage station and bar 100. The ballast containers 66 are shipped empty and ballast, such as sand or water, is added before placement of the ballast caps 68 on the ballast containers 66. The ballast adds significant stability to the beverage station and bar 100, giving the assembly the stability of a permanent structure. Removal of the ballast panel 64 allows the ballast containers 66 to be removed for movement of the beverage station and bar 100. In at least some embodiments, a flip door panel 74 is provided between the drawers 52. An adjustable shelf 78 (see FIG. 10) may be provided behind the flip door panel 74. The shelf 78 may be adjusted to allow the insertion of a small refrigerator (not shown). The drawers 52 may include Styrofoam coolers 80 sized to fit within the drawers to hold beverages, ice or the like. A foot rail 36 is secured to the interlocking panels 16 and, in some embodiments, includes a plurality of base loops 38; the base loops 38 resting on a ground surface. This structure increases the size of the base of the beverage station and bar 100, and any force applied by a patron is transferred directly to the ground surface without tipping the bar. A cord accessory cap 70 is provided to allow the routing of an electrical cord through the beverage station for accessories. The cord accessory cap 70 includes a door 72 sized to allow the plug of an electrical cord to pass through a panel 16 and into the interior of the beverage station. Some embodiments include a battery pack 76 attachable to LED rope lights or the like which can be secured around the perimeter of the bar panel 18. The battery pack 76 includes a switch for selectively turning the LED lights on and off.

Figure 34:
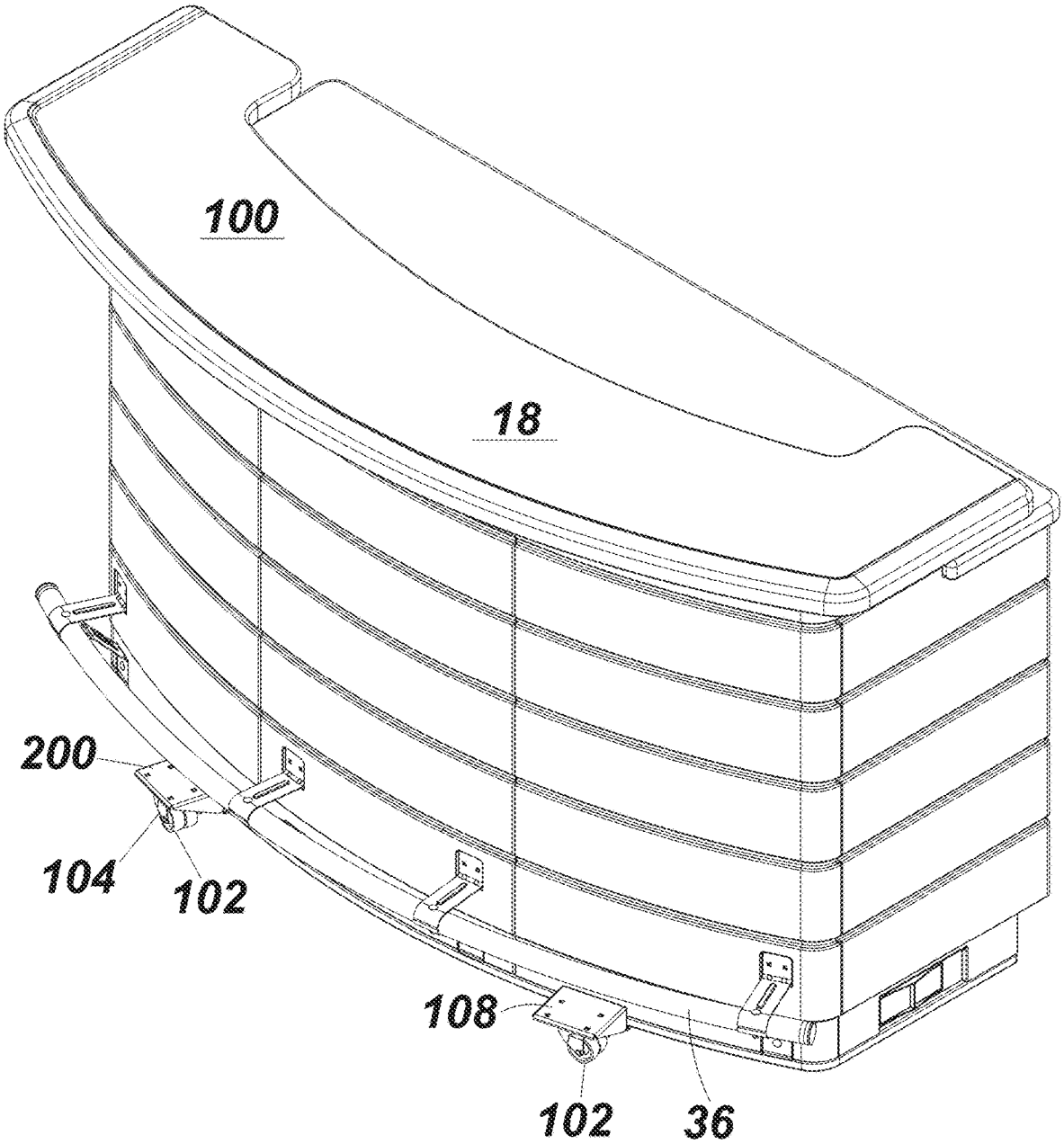
FIG. 34 is a top front right perspective view of one embodiment of the beverage station and bar including outrigger beams and caster wheels.
Figure 35:
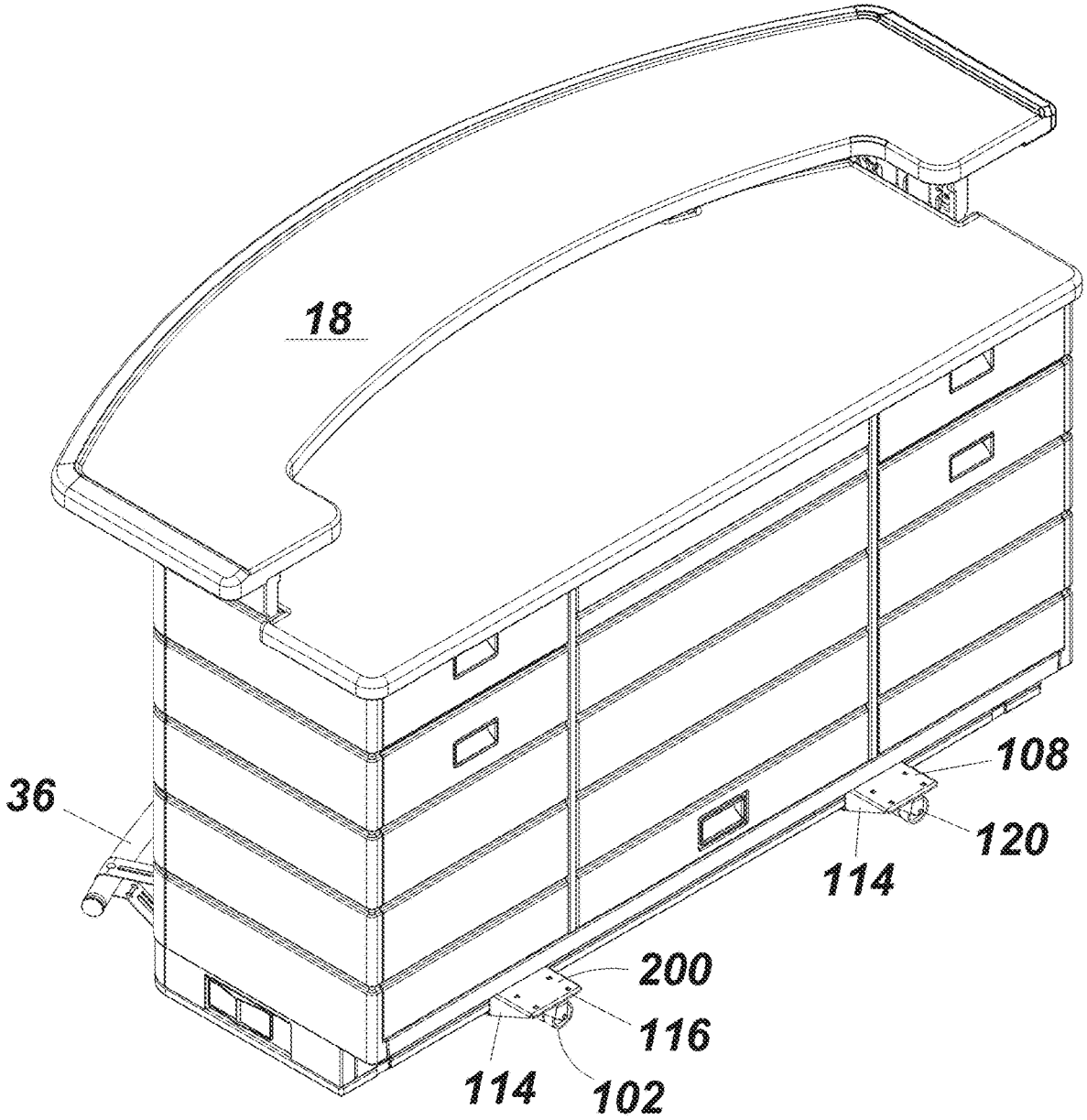
FIG. 35 is a top rear right perspective view of the embodiment of the beverage station illustrated in FIG. 34.
Figure 36:
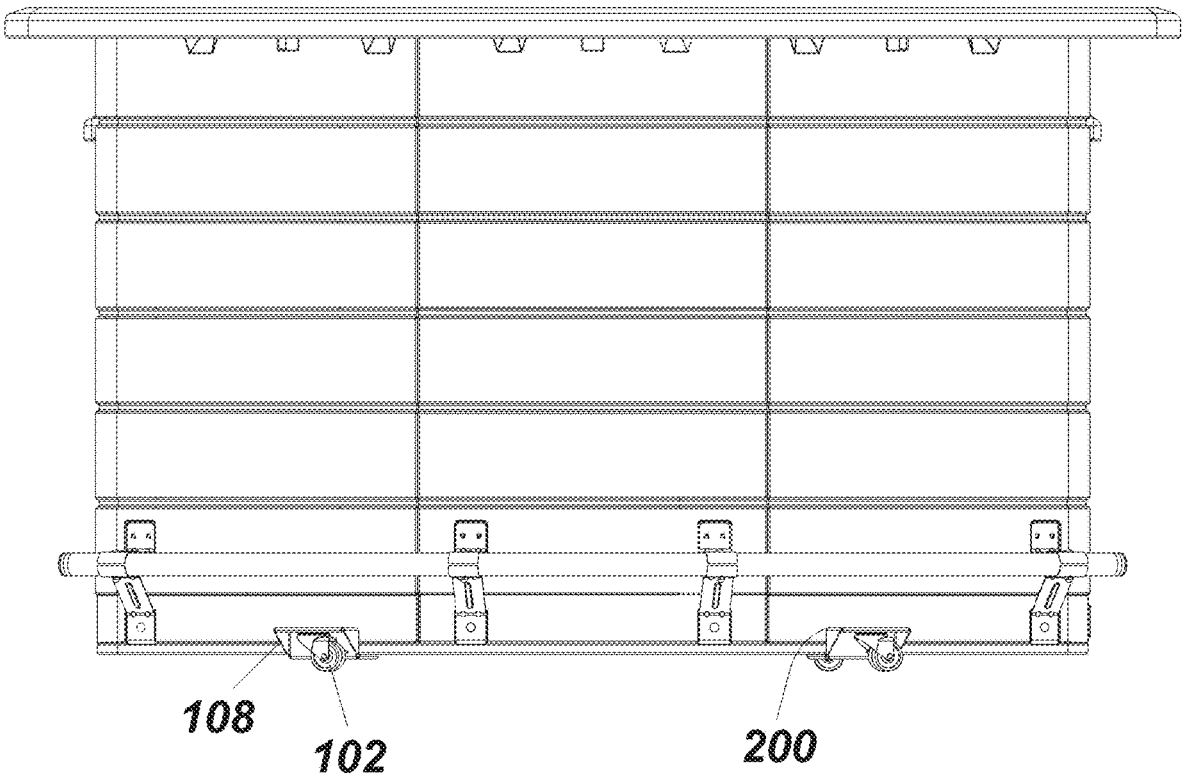
FIG. 36 is a rear view of the embodiment illustrated in FIG. 34.
Figure 37:
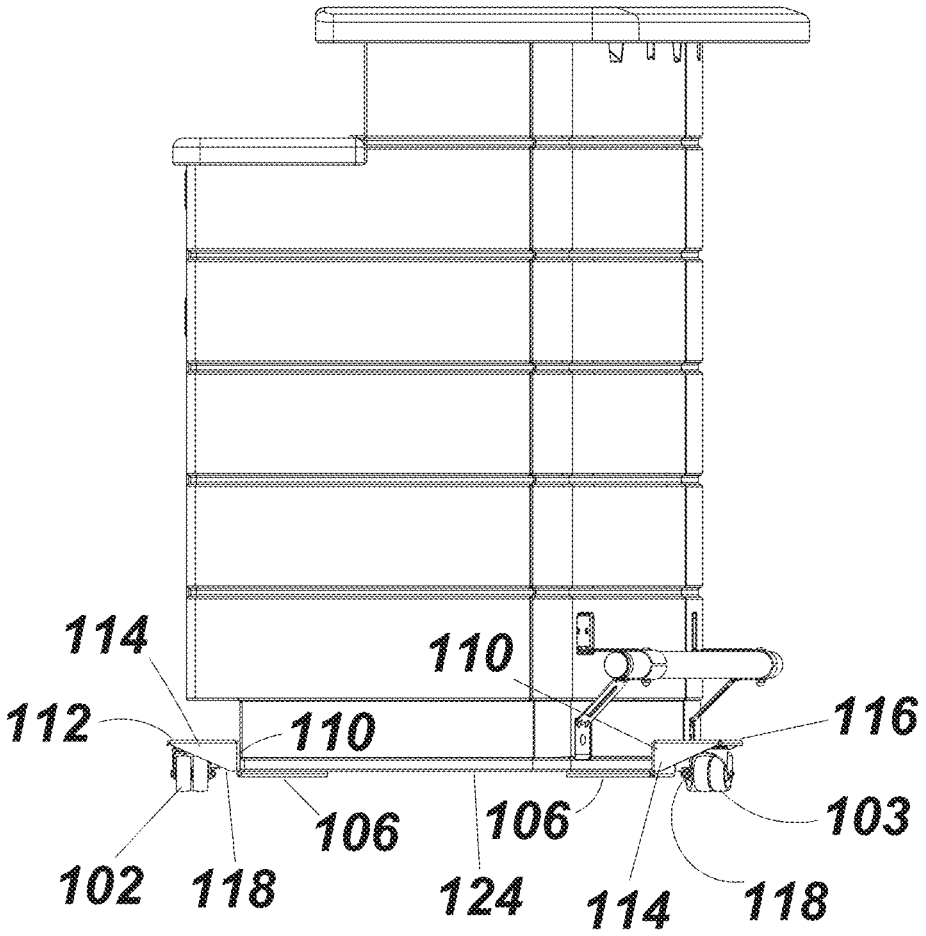
FIG. 37 is a left side view thereof.
Figure 38:
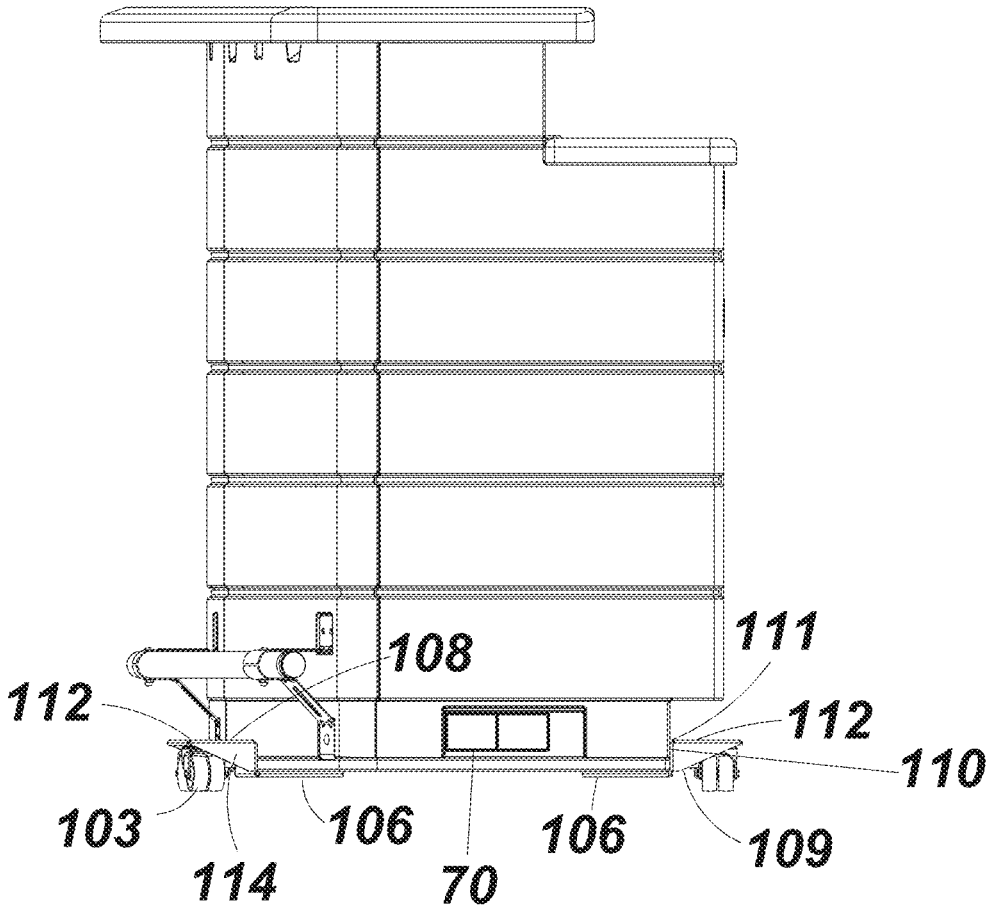
FIG. 38 is a right side view thereof.
Figure 39:
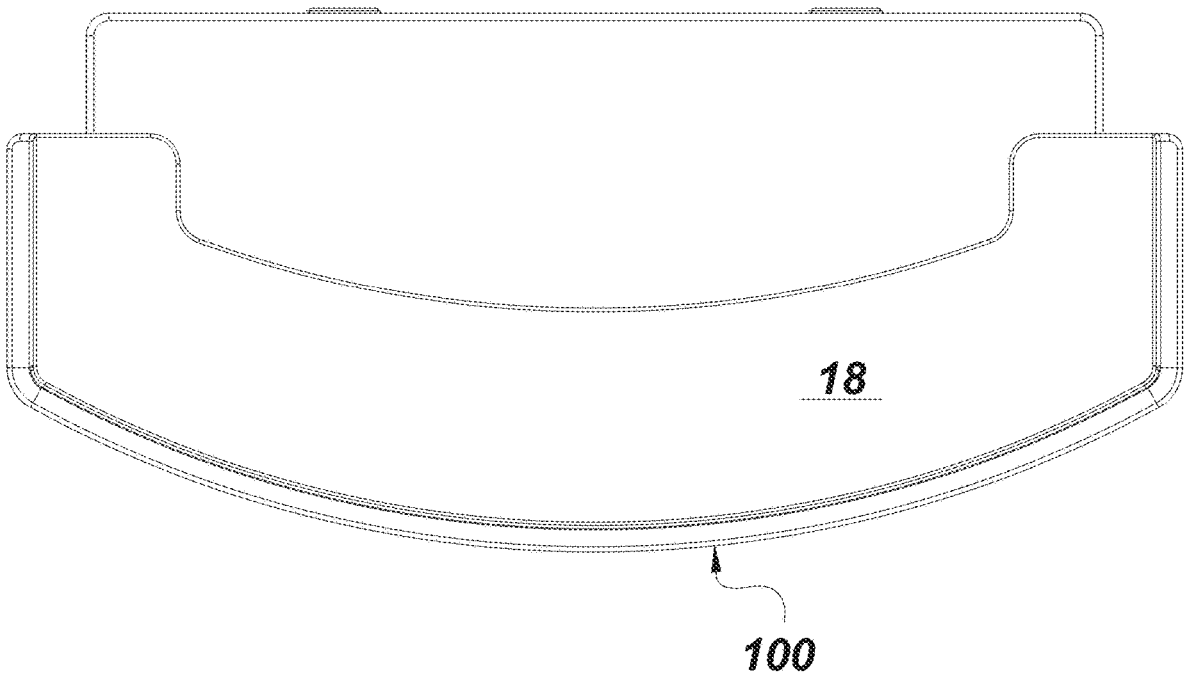
FIG. 39 is a top view thereof.
Figure 40:
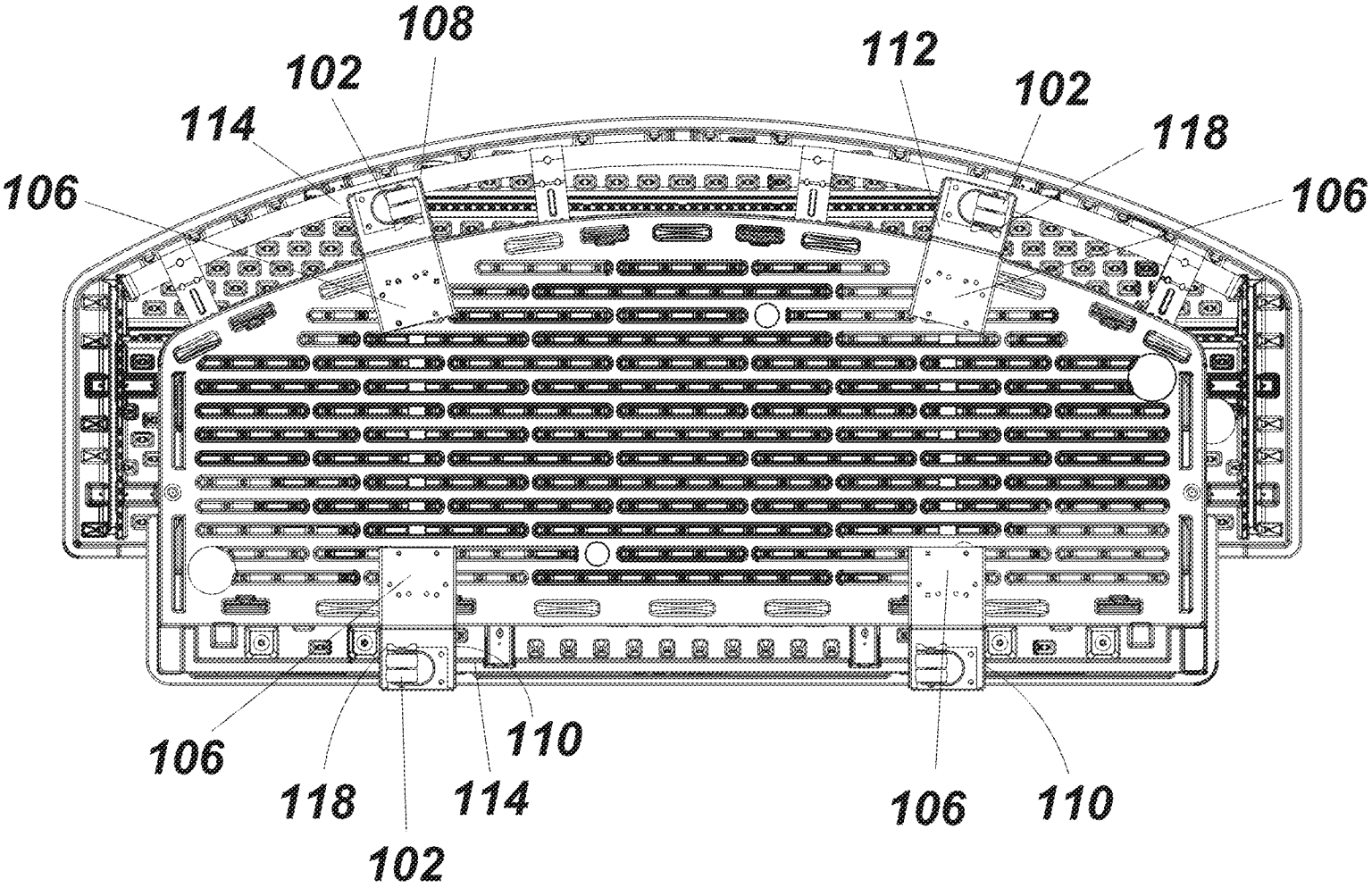
FIG. 40 is a bottom view thereof.
Figure 41:
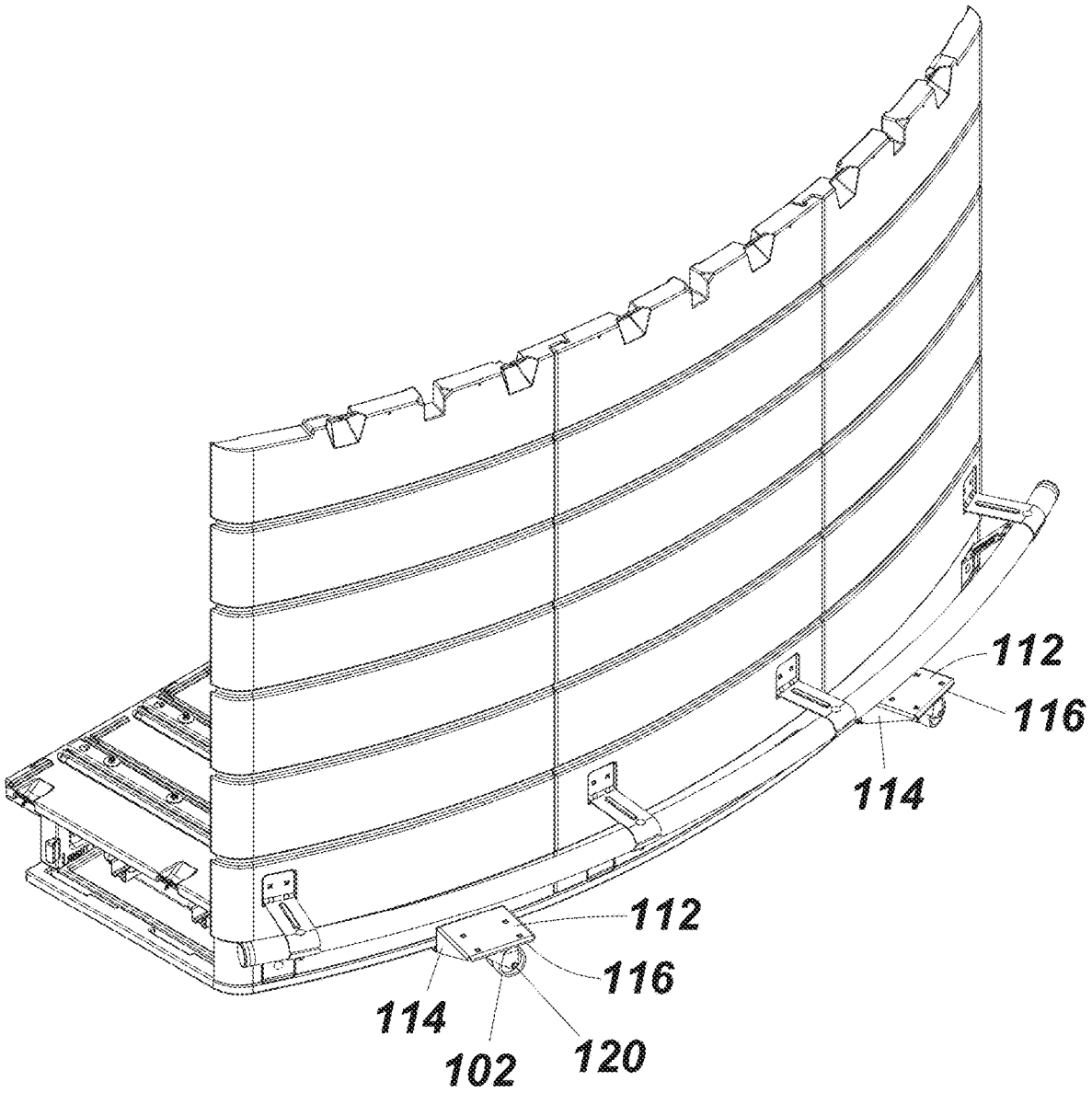
FIG. 41 is a partial top front left perspective view illustrated with panels removed.
Figure 42:
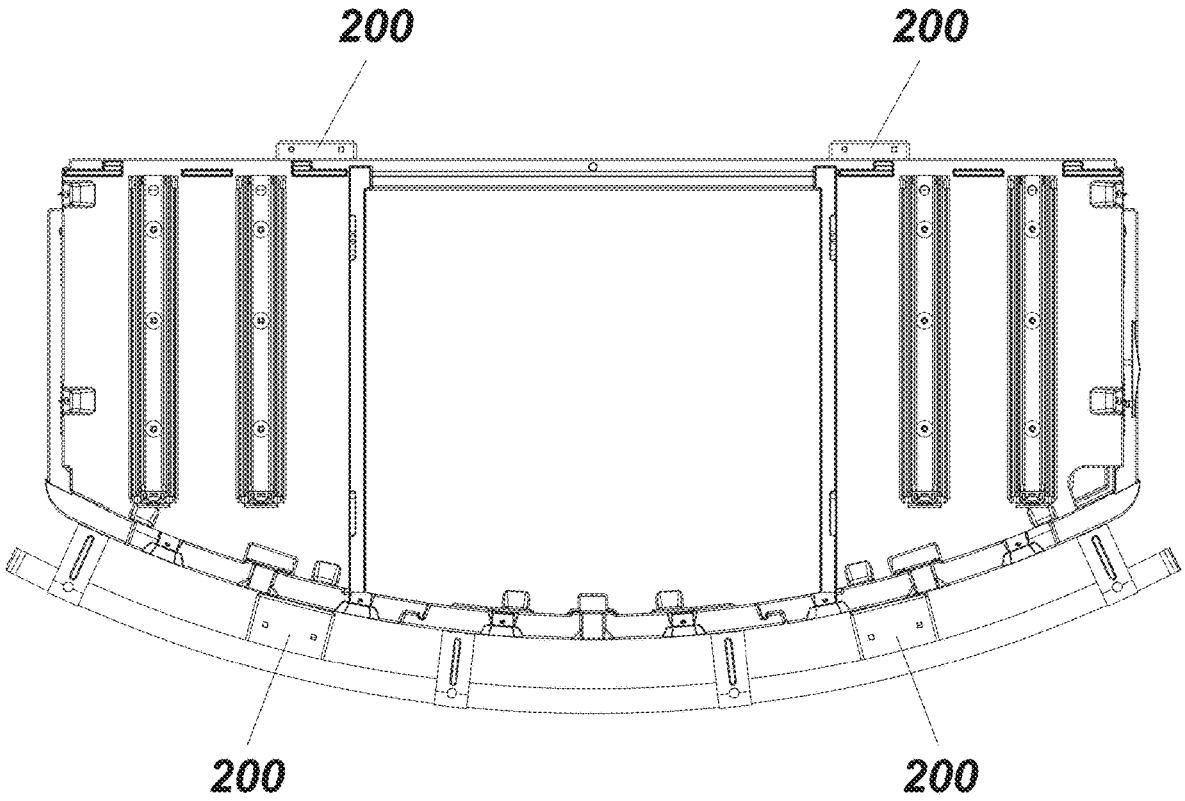
FIG. 42 is a partial top view thereof.
Figure 43:
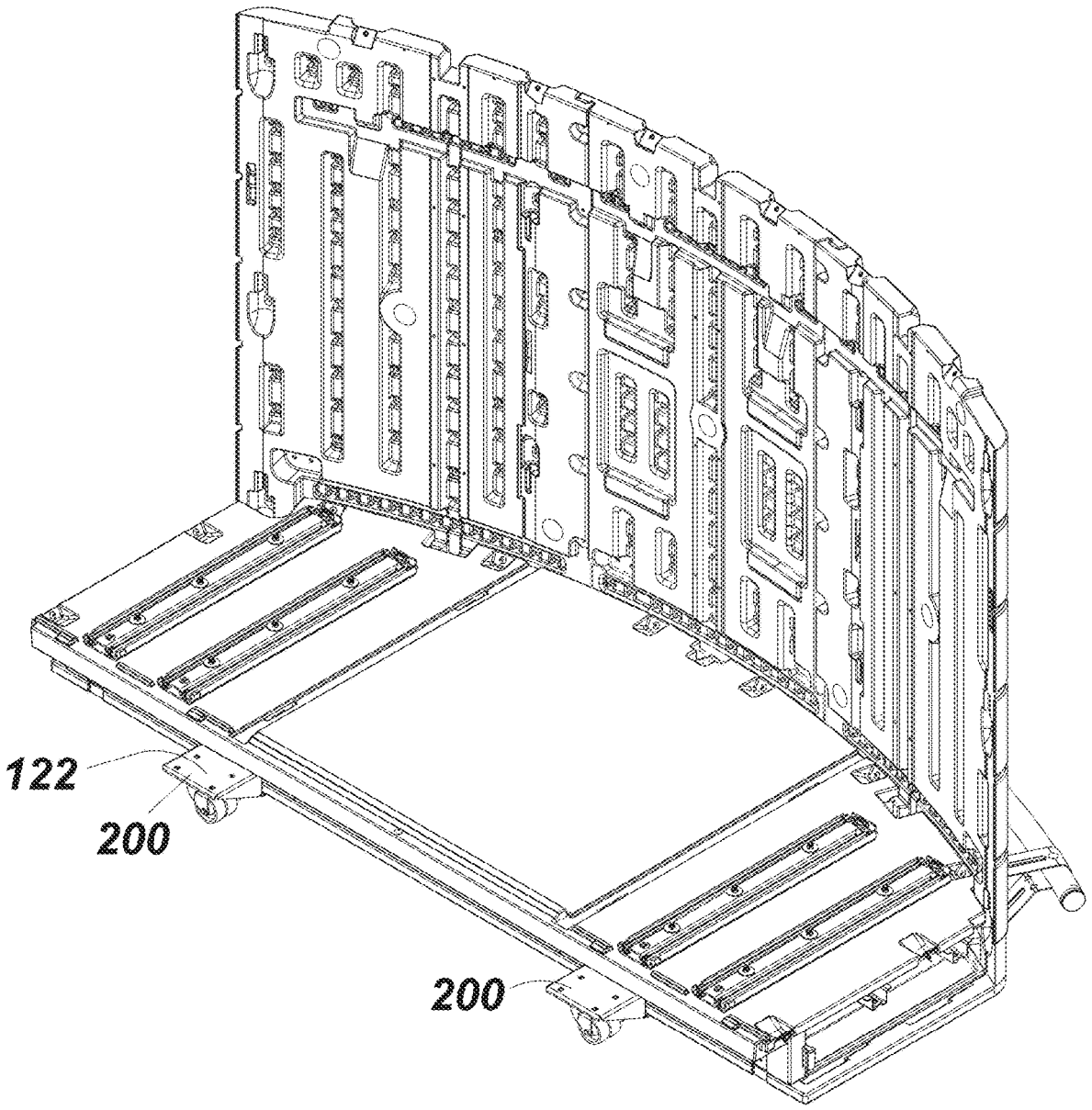
FIG. 43 is a top rear left partial perspective view thereof.
Figure 44:
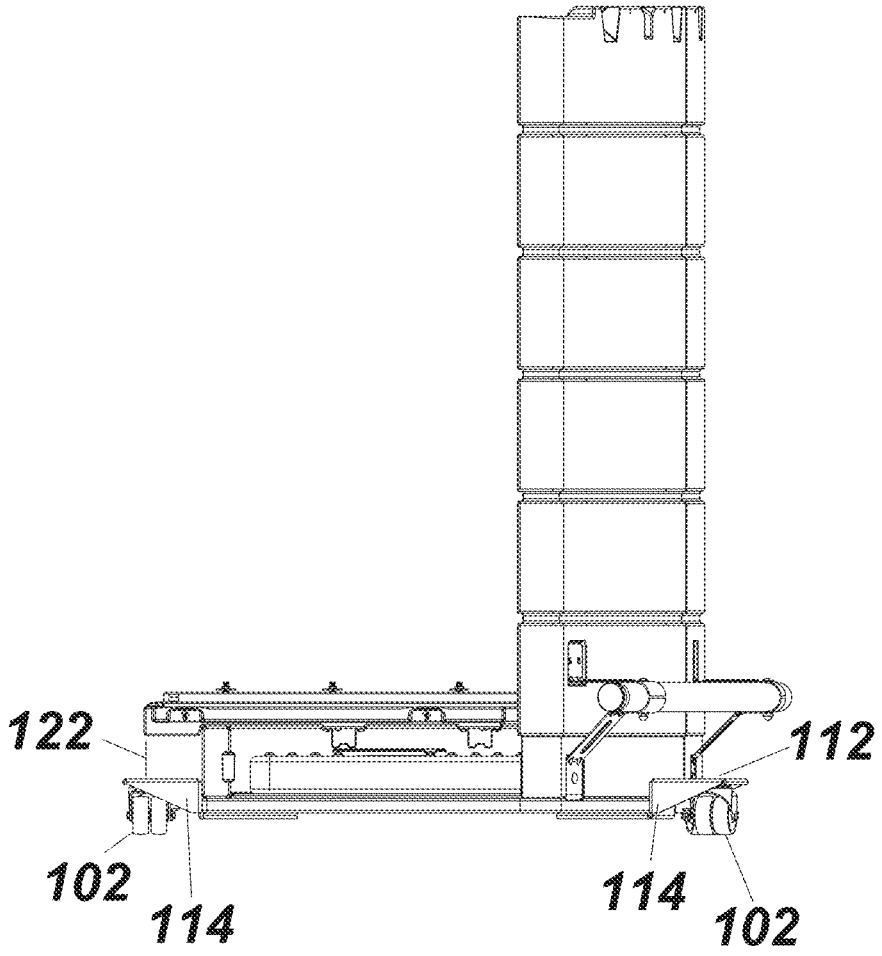
FIG. 44 is a partial left side view thereof.
Figure 45:
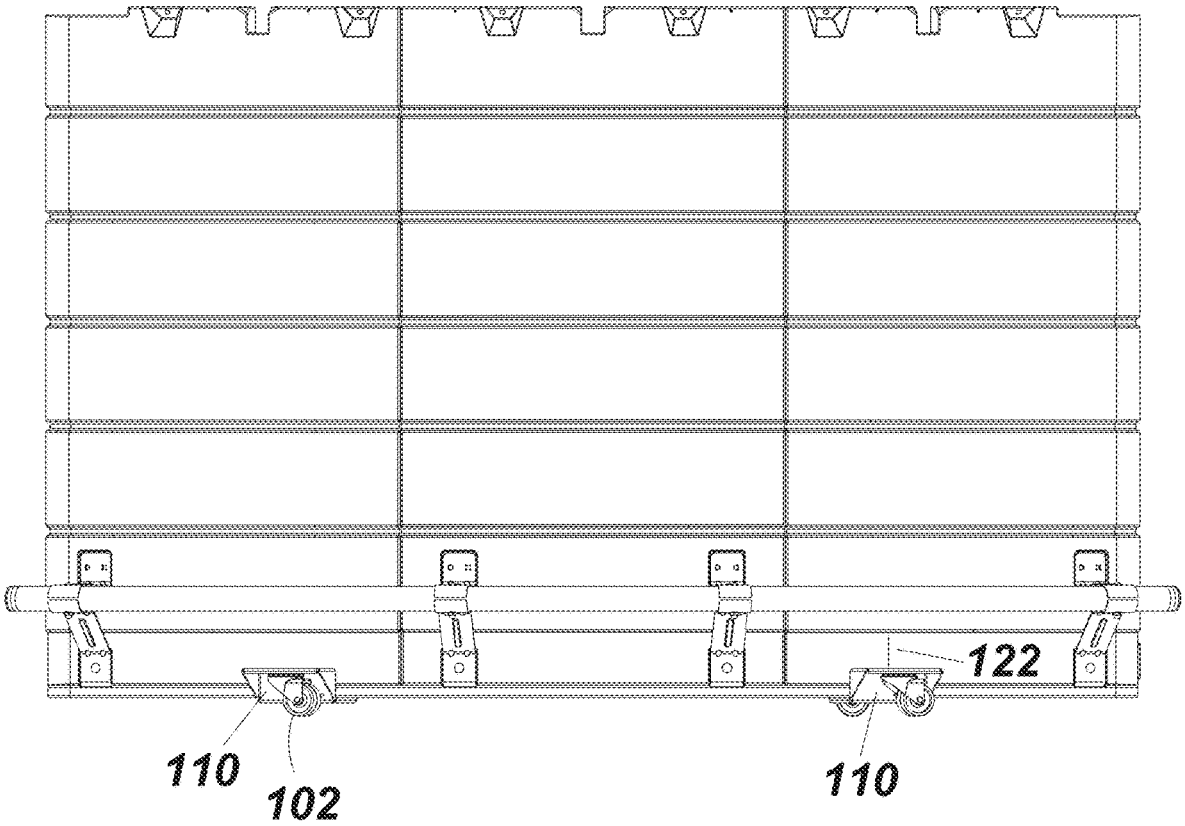
FIG. 45 is a partial front view thereof.
Figure 46:
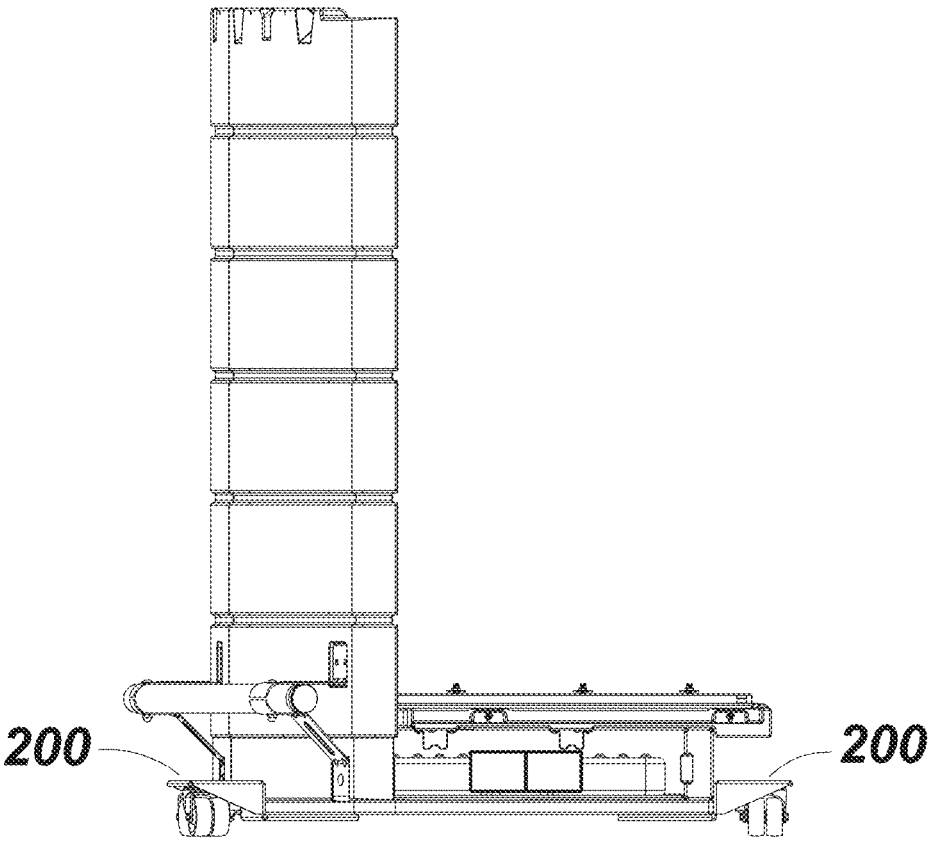
FIG. 46 is a partial right side view thereof.
Figure 47:
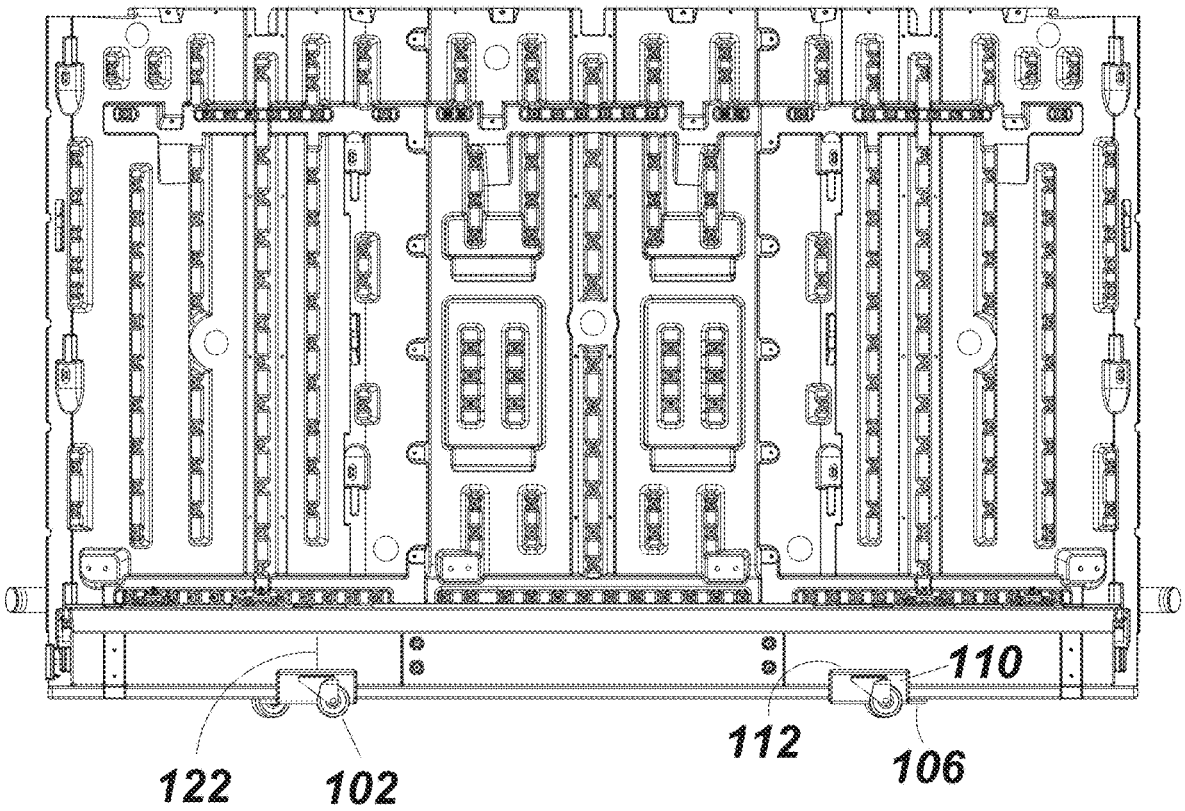
FIG. 47 is a partial rear view thereof.
Figure 48:
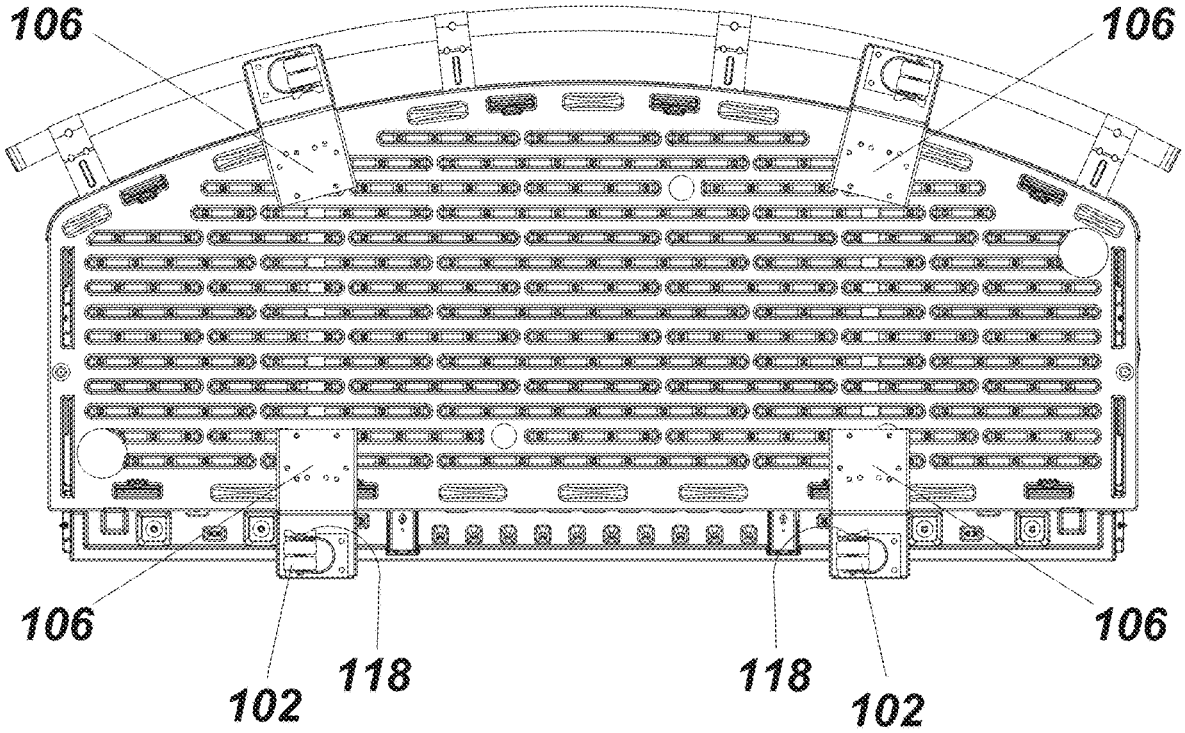
FIG. 48 is a partial bottom view thereof.

Referring generally to the figures and more specifically to FIGS. 34-48, an embodiment of the beverage station and bar 100 having wheels for providing portability to the beverage station and bar is illustrated. In this embodiment, the base assembly 22 is secured to a bottom portion 24 of the ribs 12 to allow a plurality of outrigger beams 200 to be secured to the base assembly 22. The outrigger beams 200 are constructed and arranged to extend outwardly beyond a perimeter of the space frame 10, and each respective outrigger beam 200 includes at least one wheel 102 for supporting the weight of the beverage station 100 and for allowing wheeled movement of the beverage station. Thus, the outrigger beams 200 position the wheel(s) outside of the perimeter of the beverage station and bar to provide stability and reduce the tendency of the beverage station and bar to tip when patrons lean on the bar panel 18 or push their feet against the foot rail 36. In at least one embodiment, the outrigger beams 200 extend outwardly beyond the outer perimeter of the bar panel 18 when viewed from the top. In the preferred embodiment, the outrigger beams 200 each include a plate portion 106 and a box portion 108, the plate portion 106 secured to the base assembly 22, the box portion 108 securing the at least one wheel 102, both with suitable fasteners such as bolts. The box portion 108 of each outrigger 100 includes an offset wall 110 that is constructed and arranged to reduce the clearance between a bottom surface of the beverage station 124 and a ground surface so that the distance between a bottom surface of the beverage station and bar and the ground is less than the diameter of the wheel(s) 102. The offset wall 110 connects to the plate portion 106 at a bottom surface 109 thereof and to a base plate 112 of the box portion 108 at a top surface 111 thereof for supporting the wheel(s) 102. In at least one embodiment, a pair of gussets 114 are secured to the base plate 112 and the offset wall 110 to provide structural support and defining the box portion 108. A front wall 116 is secured to the base plate 112 and the gussets 114 to complete the box structure.

In a preferred embodiment, the at least one wheel is a pair of dually wheels 103 in a side by side arrangement. This construction provides increased stability and increased weight capacity, and increases the ease of rolling a loaded beverage station and bar across rough or uneven surfaces by distributing the weight across the two wheels. Typically, half of the wheel assemblies are caster wheels to provide for easy steering of the beverage station and bar when moving it. Thus, if there are four sets of wheels supporting the beverage station, then two will be casters. However, it should be noted that in some embodiments all of the wheels will be caster wheel assemblies 104 without departing from the scope of the invention. The at least one wheel 102 preferably includes a brake 118 for restricting the rotation of the at least one wheel about an axis of rotation. The brake 118 is preferably manually operated by rotation of a lever to cause friction with a side surface of a wheel. It should be noted that other types of brakes may be utilized without departing from the scope of the invention.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A beverage station (100) comprising:

a space frame (10), the space frame (10) constructed to provide structure for the attachment of interlocking outer panels (16), the space frame (10) forming a load bearing structure constructed and arranged to transfer loads to other portions of the space frame (10) to increase weight capacity and rigidity to the beverage station (100), a bar panel (18) secured to a spine portion (14) of the space frame (10) such that loads applied to the bar panel (18) are transferred through the space frame (10) and distributed to other portions of the beverage station (100), a plurality of interlocking polymeric panels (16) secured to a plurality of rib members (12), the rib members (12) secured to the spine portion (14) of the space frame (10), the panels (16) interlocked and secured to the space frame (10) to create a hybrid structure, a base assembly (22) secured to a bottom portion (24) of the ribs (12), a plurality of outrigger beams (200) secured to the base assembly (22) to extend outwardly beyond a perimeter of the space frame (10), each respective outrigger beam (200) including at least one wheel (102) for supporting the weight of the beverage station (100) and for allowing wheeled movement of the beverage station;

wherein the outrigger beams each include a plate portion (106) and a box portion (108), the plate portion (106) secured to the base assembly (22), the box portion (108) securing the at least one wheel (102);

wherein the box portion (108) of each outrigger (100) includes an offset wall (110) that is constructed and arranged to reduce the clearance between a bottom surface (124) of the beverage station (100) and a ground surface, wherein the clearance is less than the diameter of the at least one wheel (102);

wherein the space frame (10) and the interlocking panels (16) combine to create a hybrid beverage station structure.

2. The beverage station (100) as claimed in claim 1 wherein the outrigger beams (200) extend outwardly beyond the outer perimeter of the bar panel (18) when viewed from the top.

3. The beverage station (100) as claimed in claim 1 wherein the at least one wheel (102) is a pair of dually wheels (103) in a side by side arrangement.

4. The beverage station (100) as claimed in claim 3 wherein at least a portion of the dually wheels are caster wheel assemblies (104).

5. The beverage station (100) as claimed in claim 4 wherein all of the dually wheels are caster wheel assemblies (104).

6. The beverage station (100) as claimed in claim 5 wherein all of the caster wheel assemblies (104) include a manually operated brake (118).

7. The beverage station (100) as claimed in claim 1 wherein the offset wall (110) connects to the plate portion (106) at a bottom surface (109) thereof and to a base plate (112) of the box portion (108) at a top surface (111) thereof, for supporting the at least one wheel (102).

8. The beverage station (100) as claimed in claim 7 including a pair of gussets (114) secured to the base plate (112) and the offset wall (110) to provide structural support and defining the box portion (108).

9. The beverage station (100) as claimed in claim 8 wherein the box portion (108) includes a front wall (116), the front wall (116) secured to the base plate (112) and the gussets (114).

10. The beverage station (100) as claimed in claim 1 wherein the at least one wheel (102) includes a brake (118) for restricting the rotation of the at least one wheel (102) about an axis of rotation (120).

11. The beverage station (100) as claimed in claim 1 wherein the base assembly (22) includes a cross grid comprising at least two longitudinal members (26) and at least two cross members (28), the longitudinal members (26) and the cross members (28) secured together in a suitable manner to transfer load from the ribs (12) to the base assembly (22).

* * * * *